US011021937B1

(12) United States Patent
Fowler

(10) Patent No.: US 11,021,937 B1
(45) Date of Patent: Jun. 1, 2021

(54) RELIEF WELL RESTORATION, SYSTEMS AND METHODS

(71) Applicant: Bruce Austin Fowler, Portland, ME (US)

(72) Inventor: Bruce Austin Fowler, Portland, ME (US)

(73) Assignee: SEVEE & MAHER ENGINEERS, INC., Cumberland, ME (US)

( * ) Notice: Subject to any disclaimer, the term of this patent is extended or adjusted under 35 U.S.C. 154(b) by 0 days.

(21) Appl. No.: 16/260,460

(22) Filed: Jan. 29, 2019

Related U.S. Application Data

(60) Provisional application No. 62/623,052, filed on Jan. 29, 2018.

(51) Int. Cl.

| | |
|---|---|
| ***E21B 43/12*** | (2006.01) |
| ***E21B 47/00*** | (2012.01) |
| ***E21B 43/02*** | (2006.01) |
| ***E21B 34/06*** | (2006.01) |
| ***E21B 43/18*** | (2006.01) |
| ***E21B 33/12*** | (2006.01) |
| ***E03B 3/15*** | (2006.01) |

(52) U.S. Cl.
CPC ..... *E21B 43/12* (2013.01); *E03B 3/15* (2013.01); *E21B 33/12* (2013.01); *E21B 34/06* (2013.01); *E21B 43/02* (2013.01); *E21B 43/18* (2013.01); *E21B 47/00* (2013.01)

(58) Field of Classification Search
CPC ..... E21B 37/08; E21B 43/00; E21B 43/12; E21B 34/06; E21B 43/02; E21B 47/00; E21B 33/12; E21B 43/18; B09C 2101/00; E03B 3/08; E03B 3/15; E03B 3/18
See application file for complete search history.

(56) References Cited

U.S. PATENT DOCUMENTS 4,392,529 A * 7/1983 Burwell ..... E21B 37/00 166/311
4,534,413 A 8/1985 Jaworowsky
(Continued)

OTHER PUBLICATIONS

C.G.E.M. Van Beek, et al., Cause and prevention of well bore clogging by particles, (2009), pp. 89-106, Hydrogeol. J. 17 (8) 1877-1886, doi:10.1007/s10040-009-0537-9.
(Continued)

*Primary Examiner* — Nicole Coy
(74) *Attorney, Agent, or Firm* — Peloquin, PLLC; Mark S. Peloquin, Esq.

(57) ABSTRACT

Apparatuses and method to reduce a pore-water pressure of water within a subsurface formation below a first pressure, include creating a pressure discontinuity in a well for a first period of time. The pressure discontinuity is created using ambient ground water pressure. A ground water flow regulating device (GFRD) is used to create the pressure discontinuity such that the GFRD restricts ground water flow through the well, which causes a pressure below the GFRD to increase. A flow of ground water is released through the well casing after the first period of time under natural ground water pressure. The GFRD releases the flow of the ground water and the pore-water pressure decreases to a second pressure after the ground water is released and the second pressure is less than the first pressure, wherein a first purge cycle is accomplished.

22 Claims, 22 Drawing Sheets

(56) References Cited

U.S. PATENT DOCUMENTS

| | | | | |
|---|---|---|---|---|
| 4,580,629 | A | 4/1986 | Jaworowsky | |
| 4,830,111 | A * | 5/1989 | Jenkins | E03B 3/15 166/249 |
| 6,142,232 | A * | 11/2000 | Troutt | E21B 37/06 166/305.1 |
| 6,296,058 | B1 * | 10/2001 | Brieger | E21B 37/08 166/299 |
| 7,270,179 | B2 | 9/2007 | Mansuy | |
| 7,337,845 | B1 | 3/2008 | Mansuy | |
| 7,677,318 | B2 | 3/2010 | Mansuy | |
| 7,762,326 | B2 * | 7/2010 | Fullerton | E21B 43/126 166/249 |

OTHER PUBLICATIONS

Kees Van Beek, et al., Prevention of well bore clogging by intermittent abstraction, (2010), pp. 107-122, Ground Water Monitoring & Remediation, doi: 10.1111/j1745-6592.2010.01307.x.

Webpages from Aqua Freed Process. URL http://www.subsurfacetech.com/acqua-freed-process/.

* cited by examiner

SUMMARY OF RELIEF WELL REDEVELOPMENT PROGRAMS AT SCHAGHTICOKE DEVELOPMENT POWERHOUSE 2011–2016

| REDEVELOPMENT PROGRAM | REDEVELOPMENT PROGRAM COMPONENTS | | | POST-REDEVELOPMENT EFFECTS | | |
|---|---|---|---|---|---|---|
| | PROGRAM DURATION (DAYS) | REDEVELOPMENT APPROACH | REQUISITE EQUIPMENT | VWP PRESSURE REDUCTION (FEET) (3) | FLOW RATE GAIN AT WEIR (1) (GPM) | FORMATION OR GRAVEL-PACK EROSION |
| 2011 PARRATT-WOLFF(5) | 12 | BIO-ACID; OVER-PUMPING AT 40 GPM; SWABBING | CRANE / PUMP EQUIPMENT (2) | 2.0 | +0 | FEET OF SEDIMENT ACCUMULATION BY 2014 |
| 2014 CLOGGING ASSESSMENT-SME / PARRATT-WOLFF(6) | 10 | OVER-PUMPING AT 130 GPM; SWABBING; JETTING | CRANE / PUMP EQUIPMENT (2) PARTICLE COUNTER | 3.1 | +46 | FORMATION EROSION NOTED-JETTING PROGRAM HALTED |
| 2016 PHASE I TRIAL OF PACKER-PURGE SYSTEM -SME(6) | 3 | PACKER-PURGING: STATIC, JUTTERING AND PUMP ASSIST | PORTABLE HAND TOOLS, PARTICLE COUNTER | 1.1 | +5 | NONE NOTED |
| 2016 AUTOMATED PACKER-PURGE SYSTEM-SME (ONGOING) | 240 (AS IF MARCH 2017) | PACKER-PURGING: STATIC AND JUTTERING | PORTABLE HAND TOOLS, PARTICLE COUNTER | 2.7 | +19 | NONE |

NOTES:

1. WEIR FLOW RATE MEASUREMENTS ARE APPROXIMATE.
2. PROXIMITY TO OVERHEAD POWER LINES REQUIRED SHUTTING DOWN THE POWERHOUSE DURING REDEVELOPMENT.
3. AVERAGE PRESSURE REDUCTION OF VWP P-1, P-2, AND NM-3.

FIG. 13

RELIEF WELL RESTORATION, SYSTEMS AND METHODS

RELATED APPLICATIONS

This patent application claims priority from United States Provisional Patent Application titled "Relief Well Restoration, Systems and Methods," filed on Jan. 29, 2018, Ser. No. 62/623,052.

U.S. Provisional Patent Application Ser. No. 62/623,052 is hereby incorporated by reference.

BACKGROUND OF THE INVENTION

1. Field of Invention

The invention relates generally to restoring flow (well yield) in a groundwater, aka "ground water," pressure relief well and more specifically to restoring groundwater yield into wells through modulating groundwater flow patterns, in turn, reducing pore-water pressure as a function of time.

2. Art Background

Installing relief wells to mitigate excess pore-water pressures is a common strategy for achieving acceptable foundation stability at dams, powerhouses, and related structures. Relief wells are prone to clogging due to fine-grained soil particles and colloids being transported to the well screen with the continual natural groundwater flow to the well. Redevelopment and replacement of a relief well are typical solutions to well screen clogging, but these options often come at a high cost and may or may not stabilize pore-water pressures for the long term. This can present a problem that requires a technical solution.

Mobilization of various size fine particles in the natural groundwater flow to a well can result in the accumulation of blockages within the pore throats of the subsurface strata (soils and gravel-pack) surrounding a well thereby reducing well yield and increasing pore-water pressure. This can present a problem that requires a technical solution.

Wells used for extracting groundwater disrupt natural groundwater flow patterns and velocities in the subsurface stratigraphy, and in doing so create conditions at the well screen that can produce clogging. Clogging can result in reduction of a well's specific capacity, and, ultimately, production capacity. This can present a problem that requires a technical solution Some relief wells, while not operating with pumps, are groundwater extraction instruments, continuously discharging to their sub-grade header piping to maintain a desired groundwater elevation at a specific well location. As a result, the potential for particle accumulation and, in turn, well clogging is significant. This can present a problem that requires a technical solution.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

FIG. 13 illustrates a comparison of pore-water pressure reduction methods with embodiments of the invention.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Systems and methods are described for the use of a Groundwater Flow Regulating Device GFRD to generate varying degrees of pressure gradient to artificially vary the groundwater flow into a relief well. The variation in groundwater flow directions and velocity provided by the GFRD creates an inertial force that dislodges clogging particles in the substrate strata pore throats proximate to the relief well, thereby restoring flow to the well and, in turn, lowering the pore-water pressure in the substrate strata. Several examples are provided in this description of embodiments that utilize a "well packer" in the GFRD thereby providing the ability to "plug" the relief well, which stops the flow of water into the well. Release of the packer permits the flow to resume under a pressure gradient provided by the local pore-water pressure and the static pressure existing in the well at the time of flow resumption. While specific examples are provided herein using a well packer or simply "packer" no limitation is implied thereby. Thus, the terms GFRD and packer are used interchangeably in this description of embodiments. The terms "groundwater" and "ground water" are used synonymously herein.

Reduction of pore-water pressure in a substrate strata (formation) is described in conjunction with the figures that follow, according to embodiments of the invention. These systems and methods are described in terms of a reduction in pore-water pressure obtained from a "purge cycle." Where a "purge cycle" refers to an interruption of a natural ground water flow in a well casing and then a resumption of the natural ground water flow through the well casing where a pore-water pressure measured at a location in the formation decreases following the purge cycle.

Figure 1A:
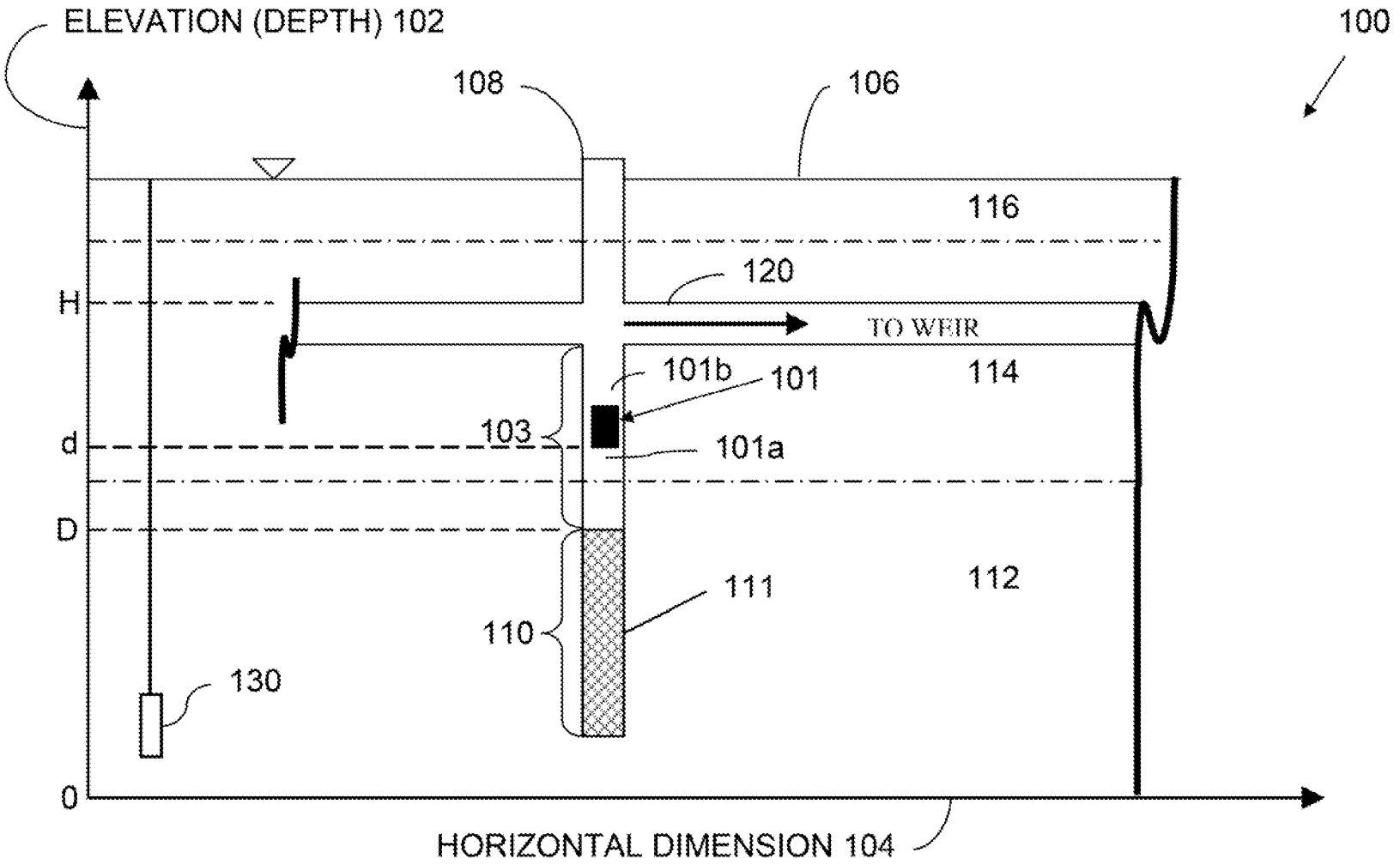
FIG. 1A illustrates a cross-sectional view of a well installation, according to embodiments of the invention.

FIG. 1A illustrates a cross-sectional view of a well installation, according to embodiments of the invention. With reference to FIG. 1A, a cross-sectional view of a well installation is shown generally at 100. Elevation above a reference, such as is indicated with 0, or alternatively depth, relative to a grade 106, is indicated on a vertical axis 102. A horizontal dimension is indicated on a horizontal axis 104 and a free surface or grade level is indicated at 106. Embodiments of the invention are applicable to wells of various configuration. Shown merely for illustration in FIG. 1A, and with no limitation implied thereby, is a well casing 108 connected to a sub-grade groundwater collection header (header) 120. The header 120 is used to divert water from the well casing 108. A top of the header is indicated by a symbol H. In some well configurations the header 120 is at grade level or above grade level. As used in this description of embodiments, the term "header" will be understood to encompass any header configuration, i.e., sub-grade headers, headers located at grade level, and headers located above grade level. A portion of the well 110 containing a screen 111 is attached to the well casing 108 and extends for a distance as shown at the bottom of the well. Alternatively, the portion of the well 110 containing the screen 111 can be located a distance up from a bottom of a well. The well screen 111 presents a porous surface, typically made from stainless steel, that allows water to pass from a formation 112 into the well casing 108 and to exit the well casing 108 through the header 120 under the natural hydraulic pressure gradient that exists in the formation 112. The well casing 108 can be made from various materials such as stainless steel, black iron pipe, plastic pipe, etc. As used in this description of embodiments, "pore-water pressure" is the hydraulic pressure existing at a location in the formation at a given depth. "Pore-water pressure" is typically measured using a transducer, such as a transducer 130, which can be a vibrating wire piezometer that is installed into the formation 112 separately from the well casing 108.

A ground water flow regulating device (GFRD) is indicated at 101. The GFRD has a bottom or lower end indicated at 101*a* and a top or an upper end indicated at 101*b*. In various embodiments of the invention, the GFRD 101 can be inserted into the well casing 108 across a range of depth indicated at 103. The range of depth 103 spans a distance from a top of the well screen 111 to just below the header 120. A general position for the GFRD 101 is shown in FIG. 1A at "d." In operation, when the GFRD is activated to artificially vary the ground water flow through the well casing 108, a pressure discontinuity (or alternatively "pressure gradient") is created across a length of the GFRD 101. Thus, when the GFRD 101 activated, a pressure in the well casing 108 varies from the lower end 101*a* of the GFRD 101 to the upper end 101*b* of the GFRD 101. When the GFRD 101 is not activated, the pressure discontinuity is released and ground water flows past the GFRD 101 under the natural pressure gradient of the formation 112. In various embodiments, the GFRD 101 is a well packer configured for use as described below.

For the purpose of illustration, the subsurface can be composed of various layers such as indicated by 112, 114, and 116. In some locations, the layer 114 is rock fill and the layer 116 is glacial till. Embodiments of the invention are applicable to various subsurface stratigraphy and no limitation is implied by the stratigraphy illustrated in FIG. 1A.

Figure 1B:
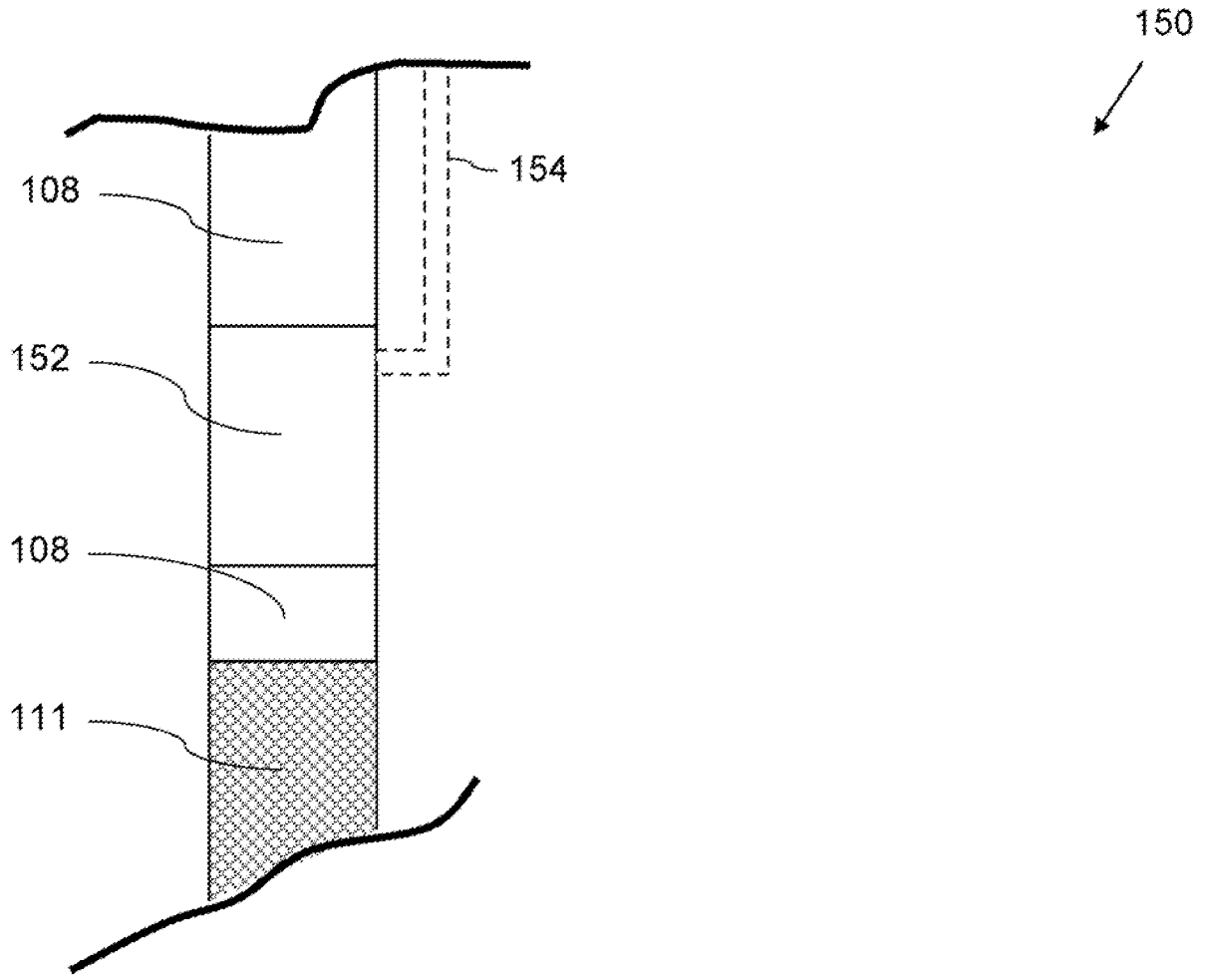
FIG. 1B illustrates a ground water flow regulating device (GFRD) installed, in situ, according to embodiments of the invention.

FIG. 1B illustrates, generally at 150, a (GFRD) installed, in situ, according to embodiments of the invention. With reference to FIG. 1B, a GFRD 152 is coupled to the well casing 108 and is referred to "in situ" meaning that the GFRD is installed when the well casing 108 and screen are installed and is coupled thereto. The GFRD 152 can be located at any point along the range of depth indicated at 103. The GFRD 152 can be fitted with controls 154 external to the well casing 108. While the description below is presented in terms of a GFRD (including a well packer configured for use as a GFRD) that is inserted into an existing well it will be recognized that all of the functionality described below is applicable to the GFRD 152. As such, the GFRD 152 is configured with a valve and actuator mechanism to halt or restrict flow through the well. In some embodiments, the GFRD 152 can surge a gas beneath the GFRD 152 to lower a well water level in the well as well as evacuate water from above or below the GFRD. In some embodiments, the GFRD is configured to pump water back down into a formation associated with the well.

Figure 2A:
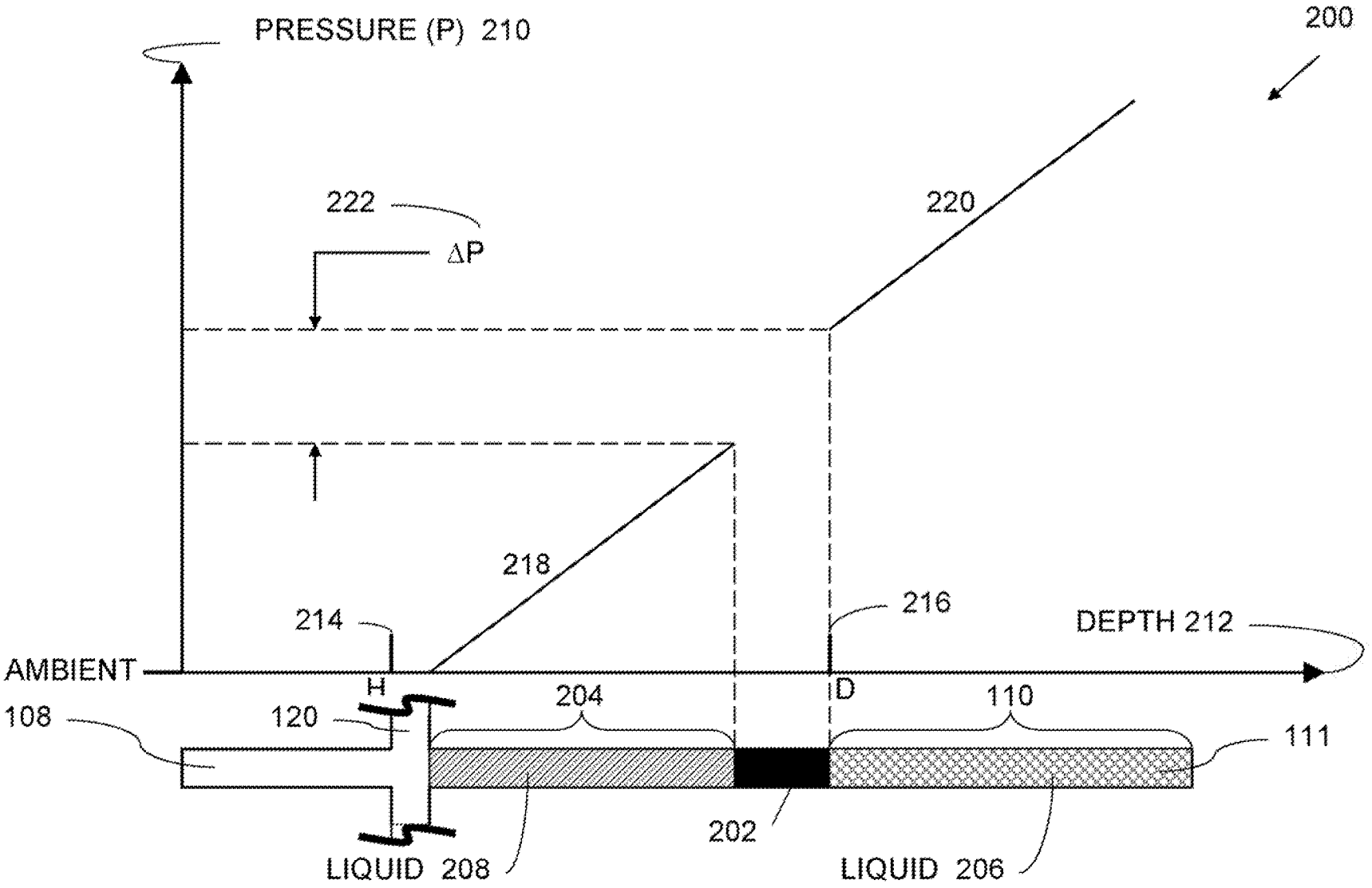
FIG. 2A illustrates a pressure-depth profile for a first technique according to embodiments of the invention.

FIG. 2A illustrates, generally at 200, a pressure-depth profile within a well for a first technique according to embodiments of the invention. With reference to FIG. 2A and FIG. 1A collectively, the first technique, realized through systems and methods, is described to reduce pore-water pressure in the formation 112. In FIG. 2A, a GFRD 202 is inserted into the well casing 108 to a depth D and is activated, thereby artificially varying the ground water flow through the well casing 108.

The pressure profile in the well casing 108 is illustrated qualitatively in graphical form with a vertical axis 210 representing pressure and a horizontal axis 212 representing depth into the well. Activation of the GFRD 202 impedes the natural ground water flow from the formation 112 past the GFRD 202, thereby causing pressure to build below the GFRD 202 in the portion 206 of the well. The natural hydraulic pore-water pressure in the formation raises the pressure to a level shown at 220 beneath the GFRD 202. The pressure profile above the GFRD is indicated at 218 and results from the height 204 of the water column 208 above the GFRD 202, thereby causing a pressure discontinuity (change in pressure) with a magnitude indicated at 222 (ΔP) from top to bottom across a length of the GFRD. Following activation, the pressure discontinuity increases as a function of time and tends to level off as a rate of change of the pressure discontinuity diminishes. The pressure discontinuity illustrated in FIG. 2A is maintained for a first period of time. The length of time necessary to obtain a pressure discontinuity can vary depending on a composition of a particular formation. However, such variation does not limit embodiments of the invention.

After the expiration of the first period of time, the GFRD is deactivated, thereby releasing the pressure discontinuity and permitting a natural ground water flow to resume under a natural ground water pressure gradient. When the natural ground water flow resumes into the well casing 108, a pore-water pressure level measured at 130 in the formation 112 decreases relative to a pore-water pressure level that existed in the formation before the purge cycle was initiated.

In various alternative embodiments, the GFRD 202 can be located at any intermediate location along the range of depths illustrated at 103 in FIG. 1A. The description given above with the GFRD located just above the well screen 111 is given merely for illustration and does not limit embodiments of the invention.

Figure 2B:
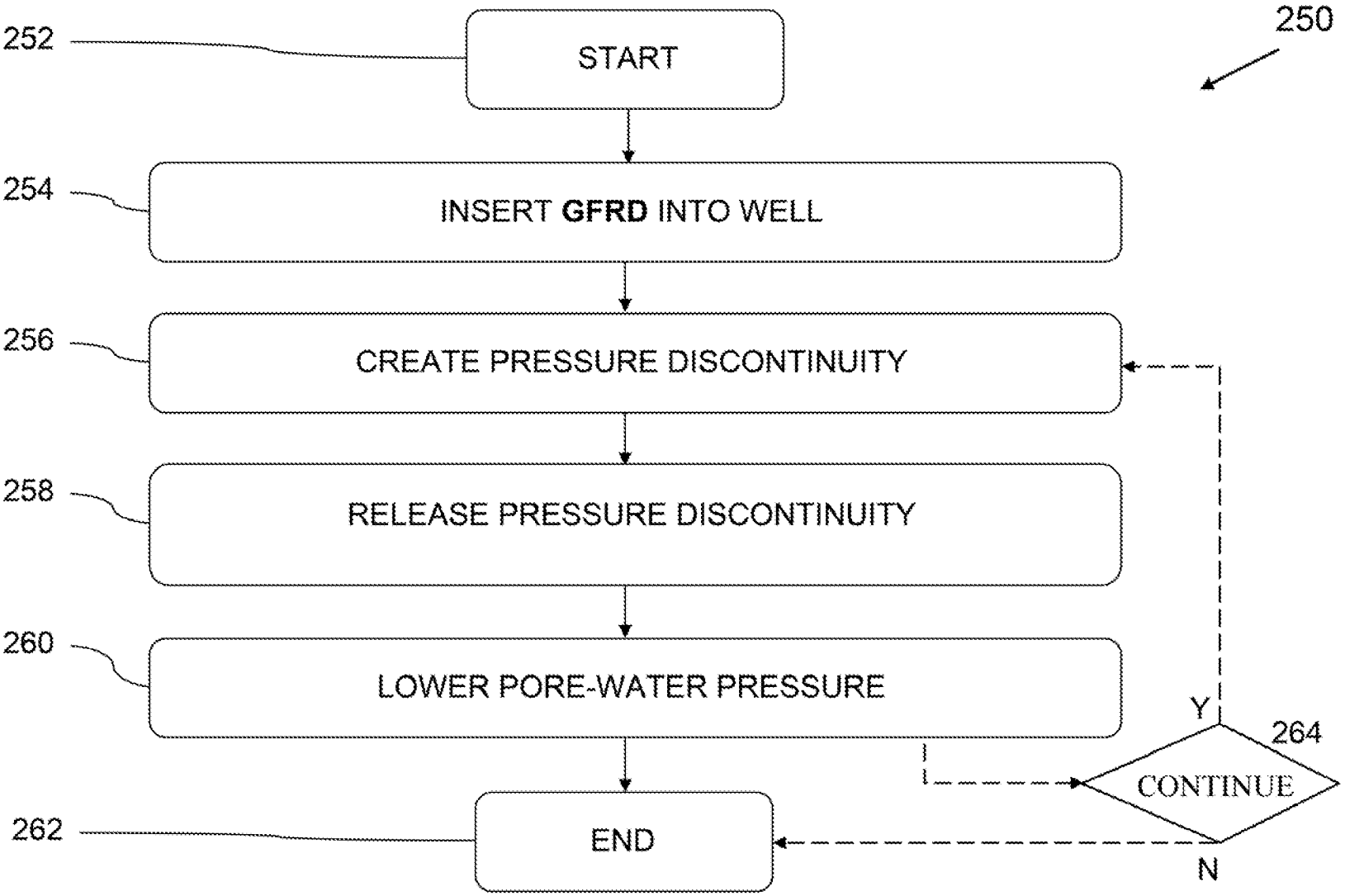
FIG. 2B illustrates methods of lowering pore-water pressure in a subsurface formation according to embodiments of the invention.

FIG. 2B illustrates, generally at 250, methods of lowering pore-water pressure in a subsurface formation according to embodiments of the invention. With reference to FIG. 2B, a method starts at a block 252. At a block 254 a GFRD is inserted into a well casing. The GFRD is inserted to a depth d within the well casing. At a block 256 a pressure discontinuity is created in a well casing with a groundwater flow regulating device (GFRD) when the natural flow of ground water is artificially varied by the GFRD for a first period of time. In some embodiments, the GFRD artificially varies the natural ground water flow by halting the flow for the first period of time. In other embodiments, the GFRD artificially varies the flow by reducing the flow. In some embodiments, the GFRD is a packer and the packer artificially varies the natural ground water flow when it inflates thereby obstructing a natural ground water flow through a well casing. A packer is described more fully below in conjunction with FIG. 5A.

At a block 258 the pressure discontinuity imposed in the block 256 is released thereby permitting a natural ground water flow to resume under natural ground water pressure. Releasing the pressure discontinuity can be accomplished by deflating a packer. At a block 260, following the functional unit of executing blocks 256/258 in order, fine particles trapped in formation around the well are dislodged and removed with the flow of water to the well. In turn, flow is increased to the well and, as a result, pore-water pressure is lowered in a formation associated with the well. Execution of the functional unit (blocks 256/258) constitutes a purge cycle. Purge cycles can be repeated at a frequency via 264 or a purge cycle can be a solitary event. A well purging program can include execution of one or more purge cycle at a frequency as described below.

Figure 2C:
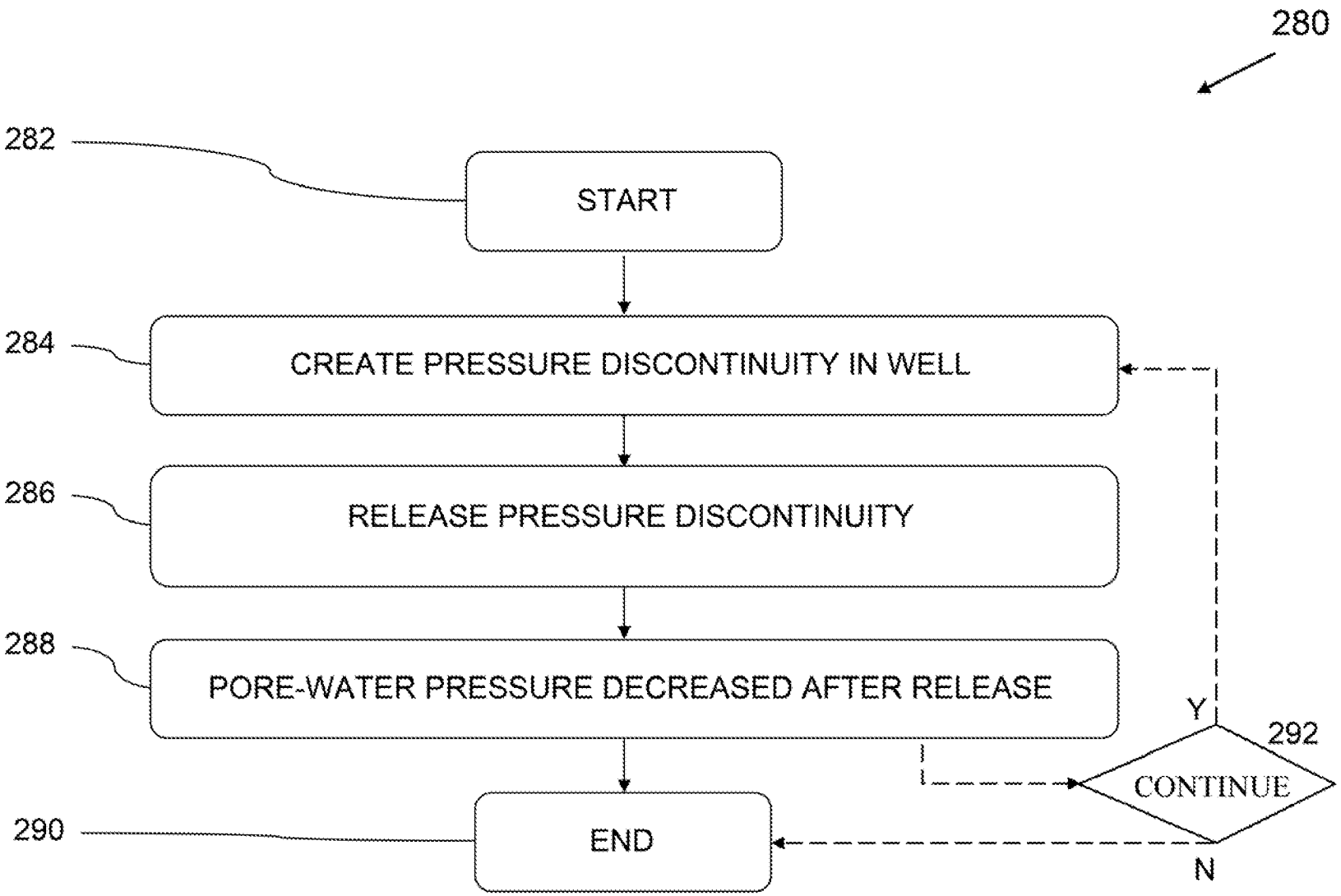
FIG. 2C illustrates additional methods of lowering pore-water pressure in a subsurface formation according to embodiments of the invention.

FIG. 2C illustrates, generally at 280, additional methods of lowering pore-water pressure in a subsurface formation according to embodiments of the invention. With reference to FIG. 2C, a method commences at a block 282. At a block 284 a pressure discontinuity is created in a well casing and is maintained for a period of time. At a block 286, the pressure discontinuity is released after the expiration of the first period of time, thereby permitting a natural ground water flow to resume under natural ground water pressure. At a block 288, following the functional unit of blocks 284/286, fine particles trapped in formation around the well are dislodged and removed with the flow of water to the well. In turn, flow is increased to the well and, as a result, pore-water pressure is lowered in a formation associated with the well. Execution of a functional unit (blocks 284/286) constitutes a purge cycle. Purge cycles can be repeated at a frequency via 292 or a purge cycle can be a solitary event. A well purging program can include execution of one or more purge cycle at a frequency as described below.

Figure 3A:
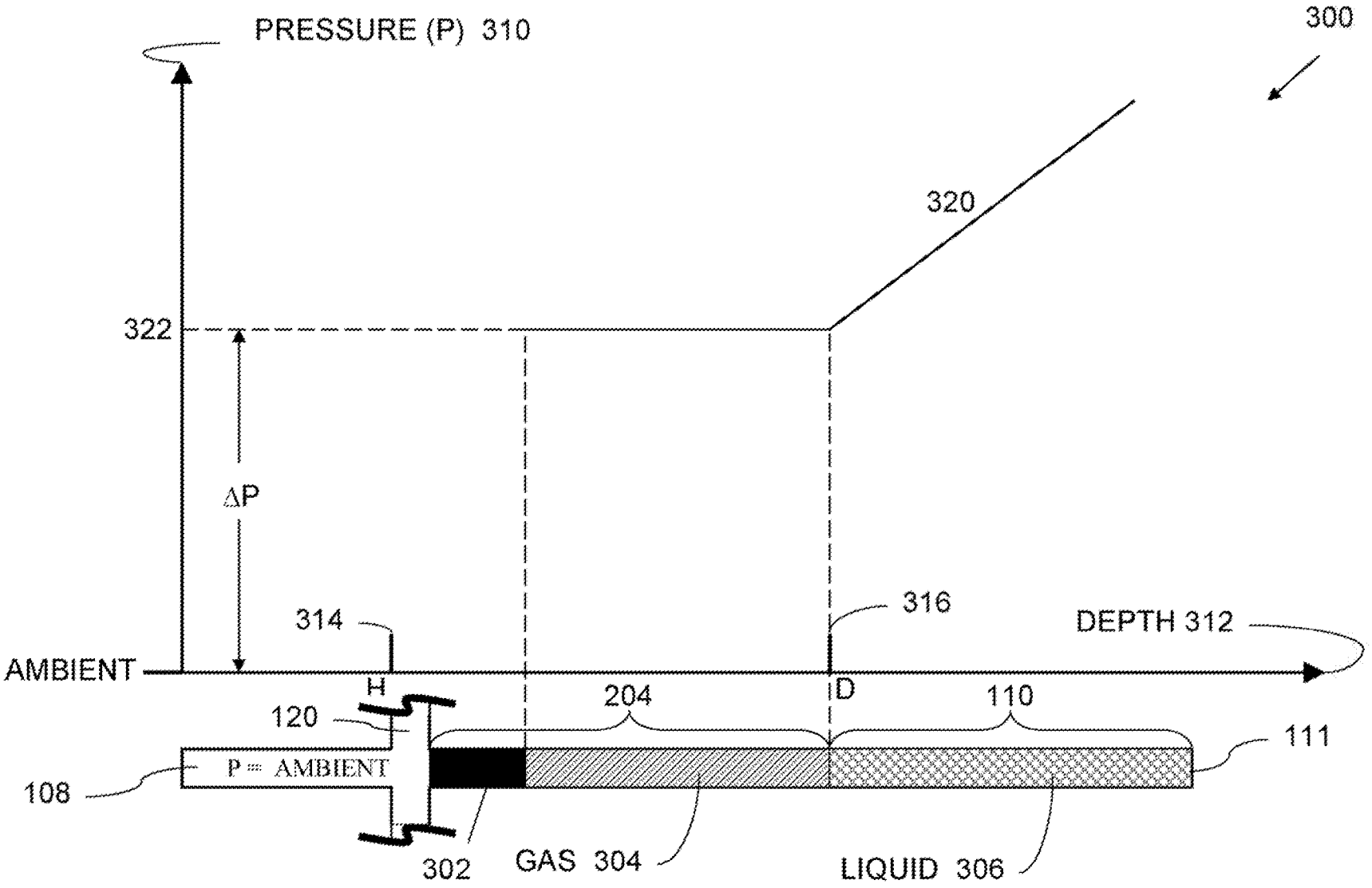
FIG. 3A illustrates a pressure-depth profile for a second technique according to embodiments of the invention.

FIG. 3A illustrates, generally at 300, a pressure-depth profile for a second technique according to embodiments of the invention. With reference to FIG. 3A and FIG. 1A collectively, a second technique, realized through systems and methods is described to reduce pore-water pressure in the formation 112. The second technique is referred to herein as Air Surging (Juttering). In FIG. 3A, a GFRD 302 is inserted into the well casing 108 to a depth just below the header 120 and is activated, thereby artificially varying the ground water flow through the well casing 108.

The pressure profile in the well casing 108 is illustrated qualitatively in graphical form with a vertical axis 310 representing pressure and a horizontal axis 312 representing depth into the well. Activation of the GFRD 302 injects a gas into the well casing 108 below the GFRD 302. The gas lowers a water level in the well casing 108 to a location indicated at 308. Water 306 remains in the portion of the well casing at 110. If air is used as the gas, then the water level is limited so that air does not enter the formation. Allowing air to interact with the well screen and the formation can facilitate growth of biological species that can clog the well. This result is to be avoided. An inert gas can be used if it is desirable to allow the gas to enter the formation. However, permitting air to enter and flow through a formation can be disruptive to the formation. Accordingly, in several embodiments, the gas is limited to a region at 204 which is the region between a top of the well screen and the bottom of the header 120. Injecting the gas into the well impedes the natural ground water flow from the formation 112, thus the ground water cannot pass the GFRD 302, thereby causing pressure to build below the GFRD 302 in the portion 306 of the well. The natural hydraulic pore-water pressure in the formation raises the pressure to a level shown at 320. From the water level 308 to a lower end of the GFRD 302, the pressure is constant as indicated 322. When the GFRD 302 is positioned just below the header 120 the pressure profile above the GFRD is equal to ambient air pressure. Thus, the pressure discontinuity (ΔP) that exists across a length of the GFRD 302 is equal to 322. Following activation, and the subsequent lowering of the water level 308 in the well, the pressure discontinuity increases as a function of time and tends to level off as a rate of change of the pressure discontinuity diminishes. The pressure discontinuity illustrated in FIG. 3A is maintained for a first period of time. The length of time necessary to obtain a pressure discontinuity can vary depending on a composition of a particular formation. However, such variation does not limit embodiments of the invention.

It should be noted that as gas 304 is injected into the well casing 108 beneath the GHRD 302, thereby lowering the water level in the well casing 108, water in the well flows backward into the formation 112. After the expiration of the first period of time, the GFRD is deactivated, thereby releasing the pressure discontinuity as the gas passes by the GFRD and permitting a natural ground water flow to resume under a natural ground water pressure gradient. When the natural ground water flow resumes into the well casing 108, a pore-water pressure level measured at 130, in the formation 112, decreases relative to a pore-water pressure level that existed in the formation before the purge cycle was initiated. Experimental measurements, described below, demonstrate that the Air Surge method produces a larger reduction in pore-water pressure than the Static Purging method produces when compared on a single purge cycle basis.

In various alternative embodiments, the GFRD 302 can be located at any intermediate location along the range of depths illustrated at 103 in FIG. 1A. The description given above with the GFRD located just below the header 120 is given merely for illustration and does not limit embodiments of the invention.

Figure 3B:
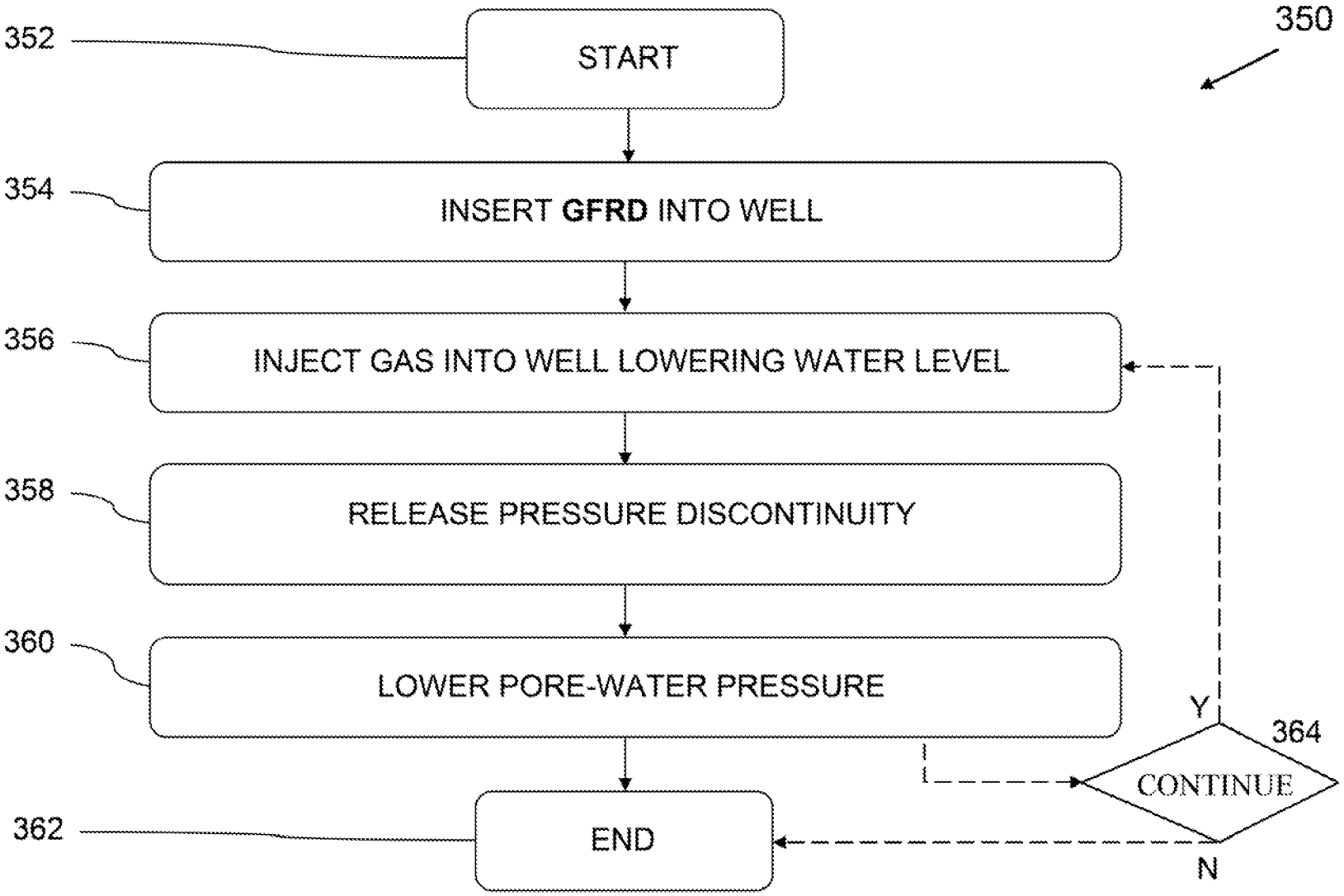
FIG. 3B illustrates methods of lowering pore-water pressure in a subsurface formation according to embodiments of the invention.

FIG. 38 illustrates, generally at 350, methods of lowering pore-water pressure in a subsurface formation according to embodiments of the invention. With reference to FIG. 3B, a method starts at a block 352. At a block 354 a groundwater flow regulating device (GFRD) is inserted into a well casing. The GFRD is inserted to a depth d within the well casing. At a block 356 a natural ground water flow through the well casing is artificially varied by injecting gas into the well beneath the GFRD. The gas lowers a water level in the well casing beneath the GFRD forcing water to flow in reverse from the well casing back into a formation. A pressure discontinuity is created across a length of the GFRD and the pressure discontinuity is maintained for a first period of time. In some embodiments, the GFRD is a packer and the packer artificially varies the natural ground water flow when it inflates thereby obstructing a natural ground water flow through a well casing. Subsequently, the packer is configured to permit pressurized gas to enter the well casing, beneath the packer, thereby lowering the water level in the well casing. A packer is described more fully below in conjunction with FIG. 5A.

At a block 358 the pressure discontinuity imposed in the block 356 is released, thereby permitting a natural ground water flow to resume under natural ground water pressure. Releasing the pressure discontinuity is accomplished by releasing the gas from beneath the GFRD resulting in a restoration of a natural ground water flow from the formation into the well casing. At a block 360, following the functional unit of executing blocks 356/358 in order, fine particles trapped in formation around the well are dislodged and removed with the flow of water to the well. In turn, flow is increased to the well and, as a result, pore-water pressure is lowered in a formation associated with the well. Execution of the functional unit (blocks 356/358) constitutes a purge cycle. Purge cycles can be repeated at a frequency via 364 or a purge cycle can be a solitary event with the method ending at a block 362. A well purging program can include execution of one or more purge cycle at a frequency as described below.

Figure 3C:
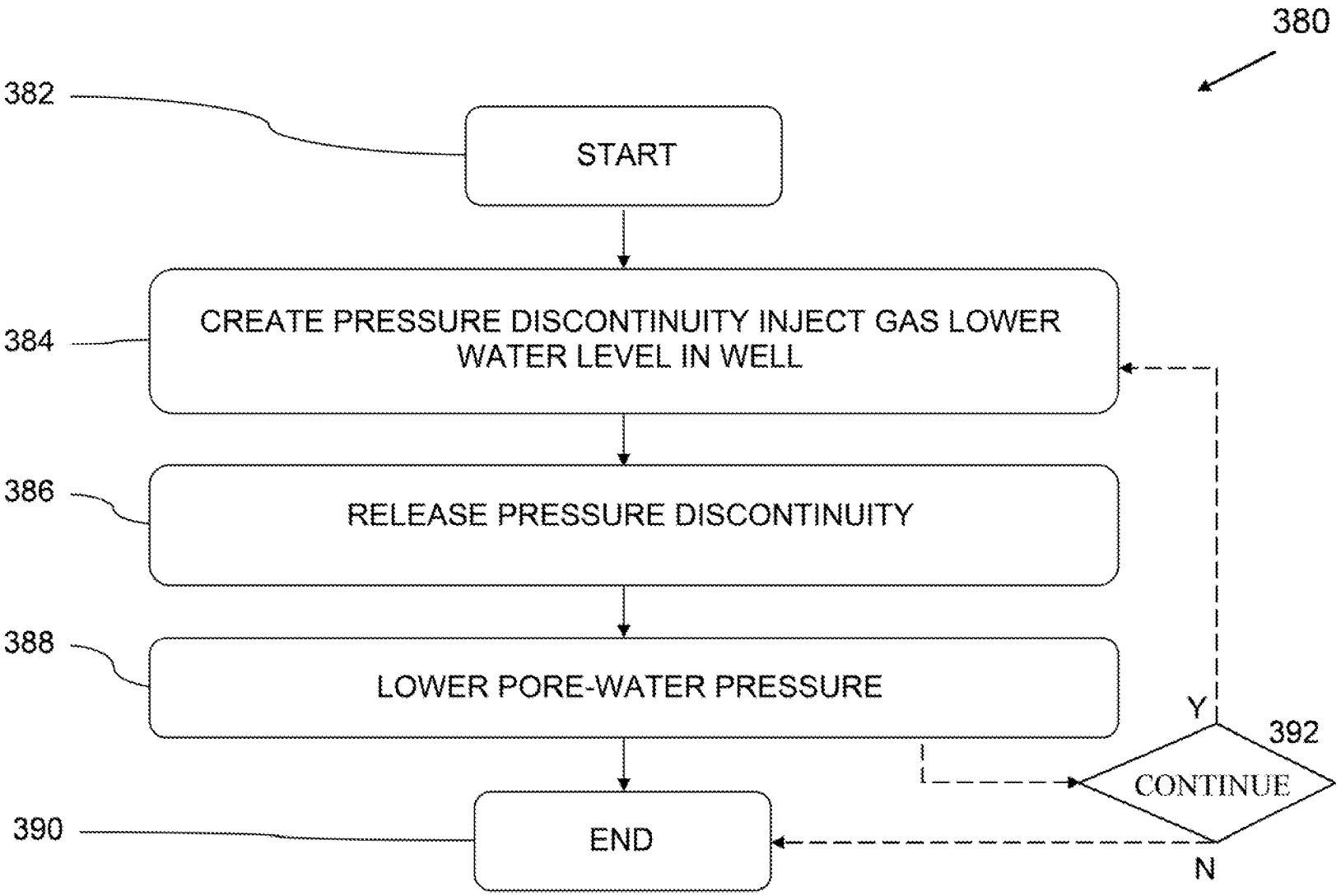
FIG. 3C illustrates additional methods of lowering pore-water pressure in a subsurface formation according to embodiments of the invention.

FIG. 3C illustrates, generally at 380, additional methods of lowering pore-water pressure in a subsurface formation according to embodiments of the invention. With reference to FIG. 3C, a method commences at a block 382. At a block 384 a pressure discontinuity is created in a well casing utilizing pressurized gas injected into the well casing. The pressure discontinuity is maintained for a period of time. At a block 386, the pressure discontinuity and the pressurized gas are released after the expiration of the first period of time, thereby permitting a natural ground water flow to resume under natural ground water pressure At a block 388, following the functional unit of blocks 384/386, fine particles trapped in formation around the well are dislodged and removed with the flow of water to the well. In turn, flow is increased to the well and, as a result, pore-water pressure is lowered in a formation associated with the well. Execution of the functional unit (blocks 384/386) constitutes a purge cycle. Purge cycles can be repeated at a frequency via 392 or a purge cycle can be a solitary event with the method ending at a block 390. A well purging program can include execution of one or more purge cycle at a frequency as described below.

Figure 4A:
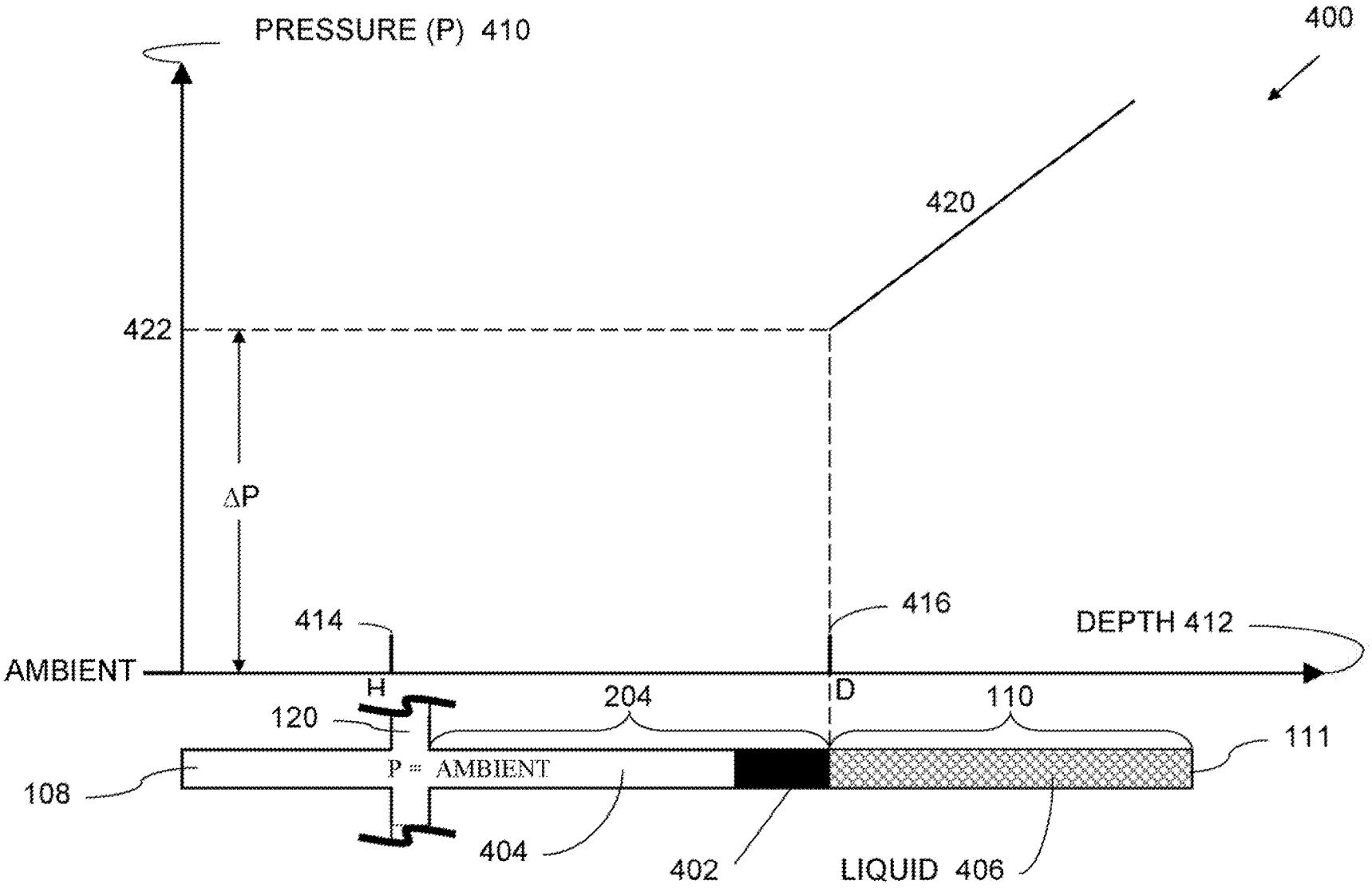
FIG. 4A illustrates a pressure-depth profile for a third technique according to embodiments of the invention.

FIG. 4A illustrates, generally at 400, a pressure-depth profile for a third technique according to embodiments of the invention. With reference to FIG. 4A and FIG. 1A collectively, the third technique, realized through systems and methods, is described to reduce pore-water pressure in the formation 112. This third technique is referred to herein as "Pump Evacuation." In FIG. 4A, a GFRD 402 is inserted into the well casing 108 to a depth just above the well screen 111 and is activated, thereby artificially varying the ground water flow through the well casing 108.

The pressure profile in the well casing 108 is illustrated in graphical form with a vertical axis 410 representing pressure and a horizontal axis 412 representing depth into the well. Activation of the GFRD 402 restricts a natural ground water flow through the well casing 108 and the water above the GFRD 402 is evacuated from the well casing 108. Water remains in the portion 406 of the well casing below the GFRD 402. Following evacuation of the water above the GFRD 402, air fills the portion of the well casing 108 indicated at 404, thereby placing the pressure on an upper side of the GFRD 402 at ambient air pressure.

Note that water can be evacuated from the well casing above the GFRD 402 along two different routes. In a first route, the water is pumped up and out of the header 120. In a second route, the water that was above the GFRD 402 is pumped down below the GFRD 402 and back into the formation. In some embodiments, combinations of the two routes are implemented with a portion of the water pumped up and out the header 120 and a portion pumped back down into the formation. In addition, "evacuated" does not necessarily mean that "all" of the water above the GFRD is removed therefrom. In some embodiments, all of the water above the GFRD is removed. In yet other embodiments, only a portion of the water above the GFRD is removed. Thus, the term "evacuated" is understood to have a flexible meaning as used in this description of embodiments.

Use of the GFRD 402 to restrict a natural ground water flow through the well casing 108 impedes the natural ground water flow from the formation 112. Since ground water cannot freely pass by the GFRD 402, natural hydraulic pressure builds below the GFRD 402 in the portion 406 of the well. The natural pore-water pressure in the formation 112 raises the pressure in the portion 406 of the well casing to a level indicated at 420. When the GFRD 402 positioned as shown, just above the well screen 111 with the water evacuated above the GFRD 402, the pressure profile above the GFRD 402 is equal to ambient air pressure. Thus, the pressure discontinuity ($\Delta P$) that exists across a length of the GFRD 402 is equal to 422. Following activation, and the subsequent lowering of the water level in the well, the pressure discontinuity increases as a function of time and tends to level off as a rate of change of the pressure discontinuity diminishes. The pressure discontinuity 422 illustrated in FIG. 4A is maintained for a first period of time. The length of time necessary to obtain a pressure discontinuity can vary depending on a composition of a particular formation. However, such variation does not limit embodiments of the invention.

After the expiration of the first period of time, the GFRD 402 is deactivated, thereby releasing the pressure discontinuity as the liquid in the portion 406 of the well casing passes by the GFRD 402 thereby permitting a natural ground water flow to resume under a natural ground water pressure gradient from the formation 112. When the natural ground water flow resumes into the well casing 108, a pore-water pressure level measured at 130, in the formation 112, decreases relative to a pore-water pressure level that existed in the formation before the purge cycle was initiated. Experimental measurements, described below, demonstrate that the Pump Evacuation method produces a larger reduction in pore-water pressure than the Static Purging method produces when compared on a single purge cycle basis.

In various alternative embodiments, the GFRD 402 can be located at any intermediate location along the range of depths illustrated at 103 in FIG. 1A. The description given above with the GFRD located just above the well screen 111 is given merely for illustration and does not limit embodiments of the invention.

Figure 4B:
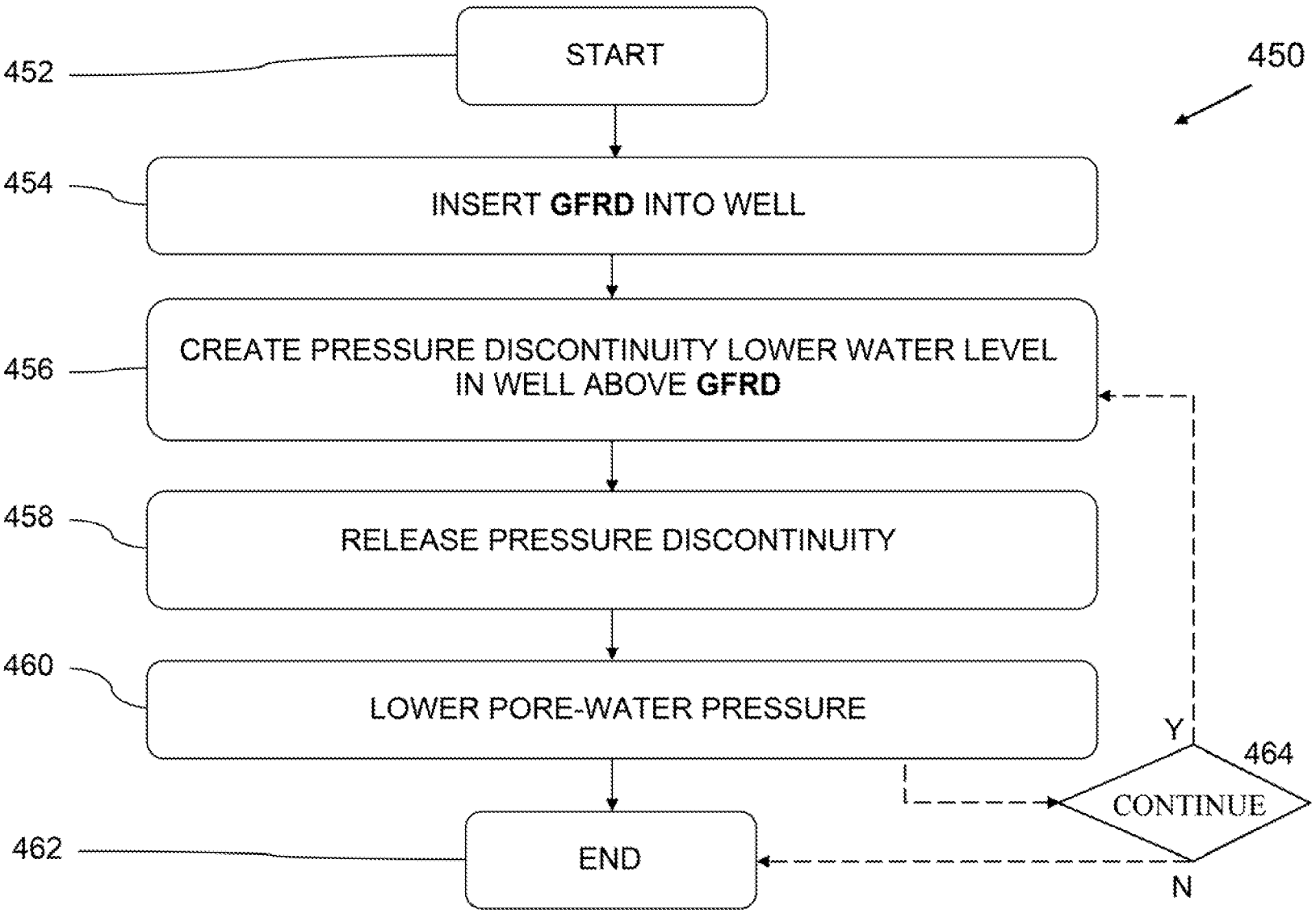
FIG. 4B illustrates methods of lowering pore-water pressure in a subsurface formation according to embodiments of the invention.

FIG. 4B illustrates, generally at 450, methods of lowering pore-water pressure in a subsurface formation according to embodiments of the invention. With reference to FIG. 4B, a method starts at a block 452. At a block 454 a groundwater flow regulating device (GFRD) is inserted into a well casing. The GFRD is inserted to a depth d within the well casing. At a block 456 a natural ground water flow through the well casing is artificially varied by restricting the flow of water through the well casing and lowering a water level in the well above the GFRD. The water level is lowered by evacuating water from the well casing above the GFRD. A pressure discontinuity is created across a length of the GFRD and the pressure discontinuity is maintained for a first period of time. In some embodiments, the GFRD is a packer and the packer artificially varies the natural ground water flow when it inflates thereby obstructing a natural ground water flow through a well casing. The packer can be configured with a pump(s) to facilitate evacuation of water from the well casing. A packer is described more fully below in conjunction with FIG. 5A.

At a block 458 the pressure discontinuity imposed in the block 456 is released, thereby permitting a natural ground water flow to resume under natural ground water pressure. Releasing the pressure discontinuity is accomplished by permitting water to flow past the GFRD resulting in a restoration of a natural ground water flow from the formation into the well casing. At a block 460, following the functional unit of executing blocks 456/458 in order, fine particles trapped in formation around the well are dislodged and removed with the flow of water to the well. In turn, flow is increased to the well and, as a result, pore-water pressure is lowered in a formation associated with the well. Execution of the functional unit (blocks 456/458) constitutes a purge cycle. Purge cycles can be repeated at a frequency via 464 or a purge cycle can be a solitary event with the method ending at a block 462. A well purging program can include execution of one or more purge cycle at a frequency as described below.

Figure 4C:
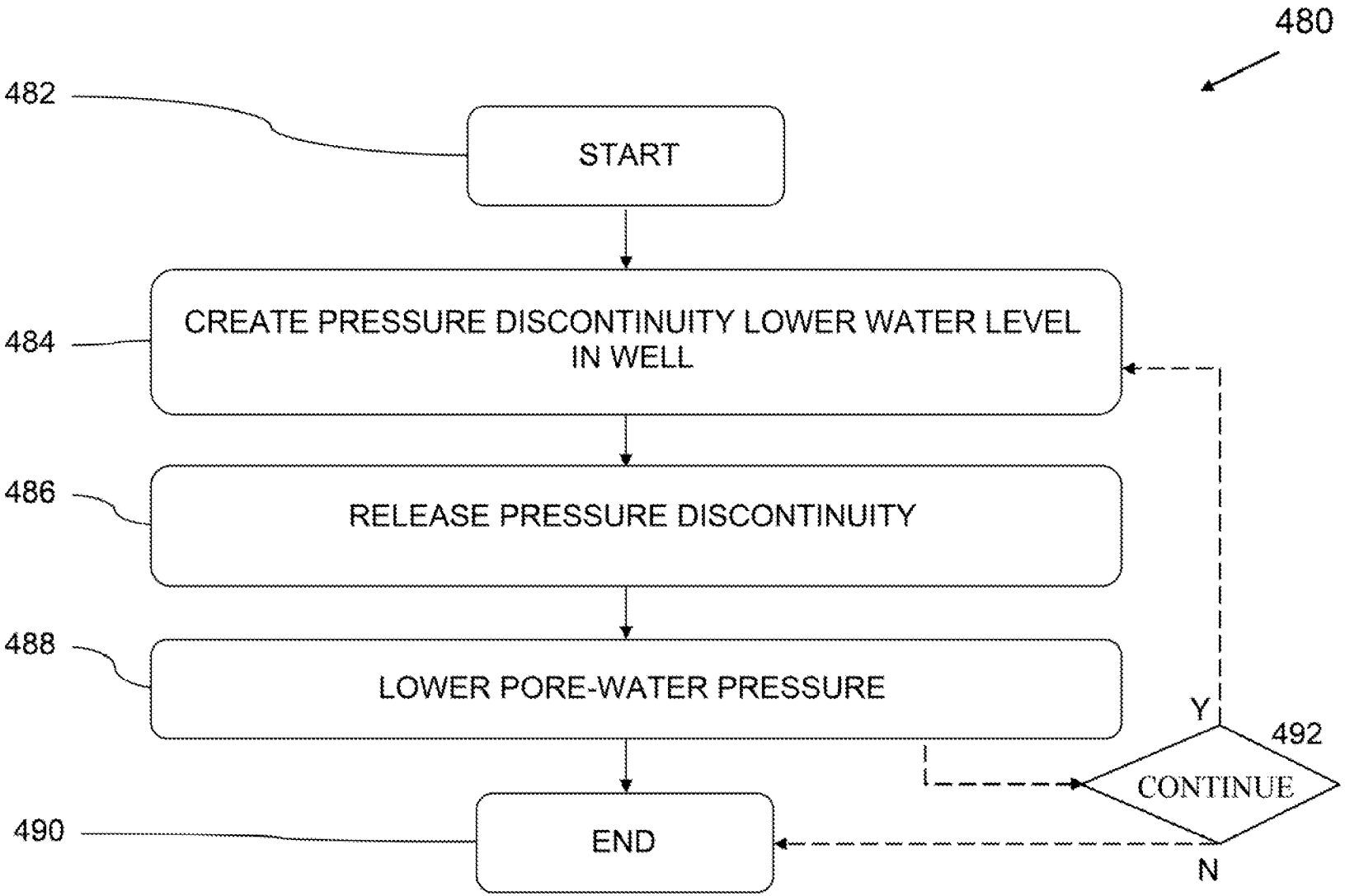
FIG. 4C illustrates additional methods of lowering pore-water pressure in a subsurface formation according to embodiments of the invention.

FIG. 4C illustrates, generally at 480, additional methods of lowering pore-water pressure in a subsurface formation according to embodiments of the invention. With reference to FIG. 4C, a method commences at a block 482. At a block 484 a pressure discontinuity is created in a well casing by lowering a water level in the well. The pressure discontinuity is maintained for a period of time. At a block 486, the pressure discontinuity and the pressurized gas are released after the expiration of the first period of time, thereby permitting a natural ground water flow to resume under natural ground water pressure. At a block 488, following the functional unit of blocks 484/486, fine particles trapped in formation around the well are dislodged and removed with the flow of water to the well. In turn, flow is increased to the well and, as a result, pore-water pressure is lowered in a formation associated with the well. Execution of the functional unit (blocks 484/486) constitutes a purge cycle. Purge cycles can be repeated at a frequency via 492 or a purge cycle can be a solitary event with the method ending at a block 490. A well purging program can include execution of one or more purge cycle at a frequency as described below.

Combining Techniques

The various techniques described above in conjunction with FIG. 1A through FIG. 4C can be combined during a single purge cycle and can be repeated or varied during subsequent purge cycles. For example, referring to FIG. 1, note that the GFRD 101 is part way between a top of the well screen indicated by D and the bottom of the header pipe 120 indicated by H. A pressure discontinuity ($\Delta P$) is created by lowering a water level in the well casing below the GFRD 101 using compressed air. In addition, a magnitude of the pressure discontinuity can be increased by evacuating water from above the GFRD, either in whole or in part, thereby creating a pressure discontinuity by combining the Air Surging technique and the Pump Evacuation technique. Such a pressure discontinuity is released by deactivating the GFRD whereby the compressed air below the GFRD is allowed to escape and the ground water flow under the natural hydraulic gradient of the formation is allowed to flow past the GFRD. Such a purge cycle lowers a pore-water pressure in a formation associated with the well. Many variations of the above combination of techniques are possible within the teaching presented herein and no limitation is implied by the specific examples give to illustrate embodiments of the invention.

Several embodiments of the invention were applied to relieve pore-water pressure at three relief wells of the Schaghticoke Development Powerhouse (the Powerhouse) in New York State. Embodiments of this invention arc related to Exhibit A which is a copy of the paper titled "*Reducing Relief Well Clogging and Pore-Water Pressures Using Natural Groundwater Pressures and a Packer-Purge System™*" *published in Association of State Dam Safety Officials* 2017 Conference Proceedings as well as The Journal of Dam Safety 2018. A subsurface investigation at the Powerhouse in the late 1990s revealed the presence of an artesian head condition in the confined sand and gravel aquifer formation beneath the Powerhouse. In 1999, three 8-inch-diameter relief wells were installed on the east side of the Powerhouse to reduce artesian pressures to the Design Basis Value determined by a stability analyses of the subsurface strata.

Figure 5A:
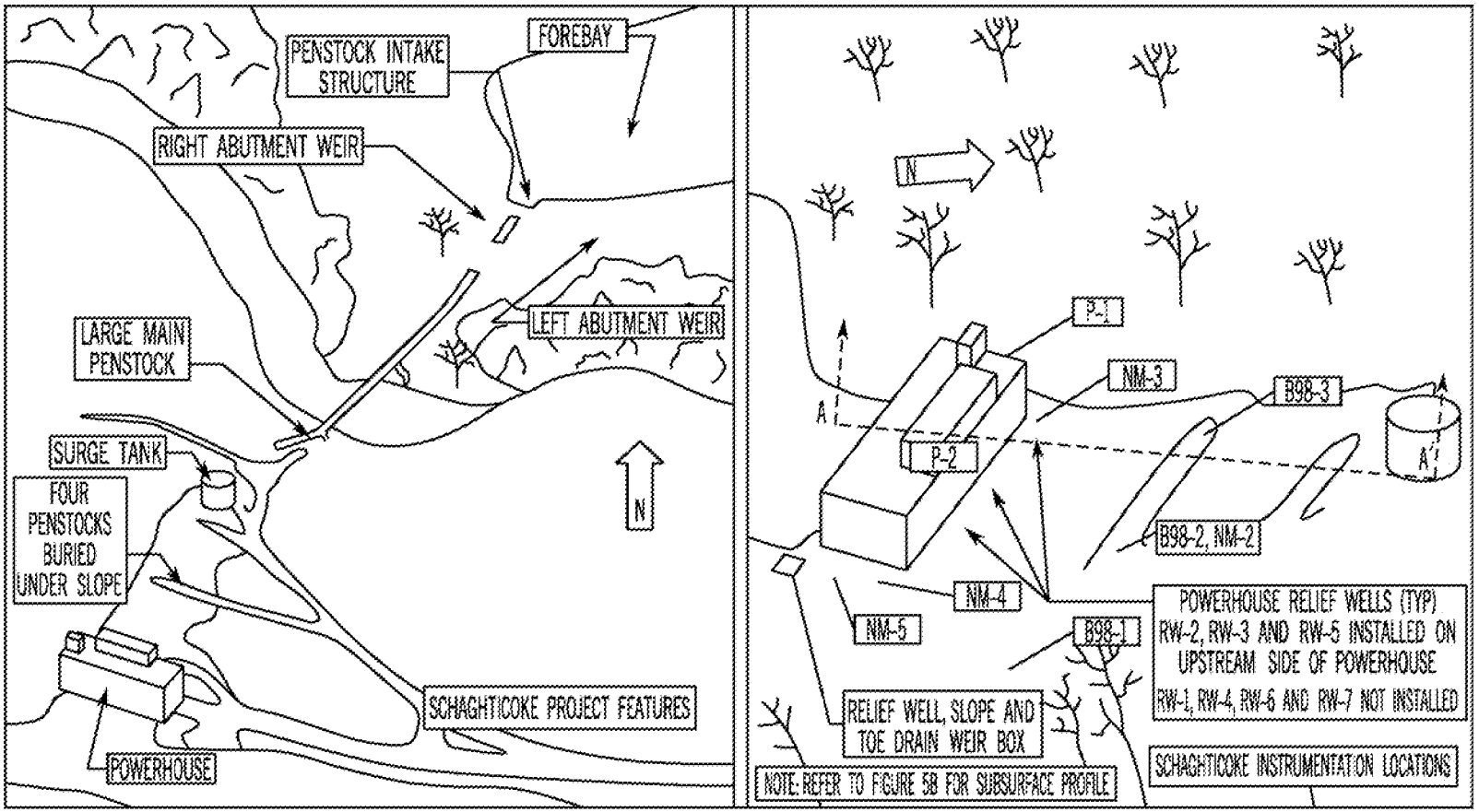
FIG. 5A illustrates a dam location with increasing pore-water pressure, where application of embodiments of the invention were applied.

FIG. 5A illustrates a dam location at the Powerhouse with increasing pore-water pressure, where embodiments of the invention were applied. With reference to FIG. 5A, an aerial view of the Powerhouse area shows the location of the three relief wells, RW-2, RW-3 and RW-5, and the five vibrating wire piezometers (VWP), NM-3, NM-4, NM-5, P-1 and P-2, used to monitor the pore-water pressures in the confined aquifer.

Figure 5B:
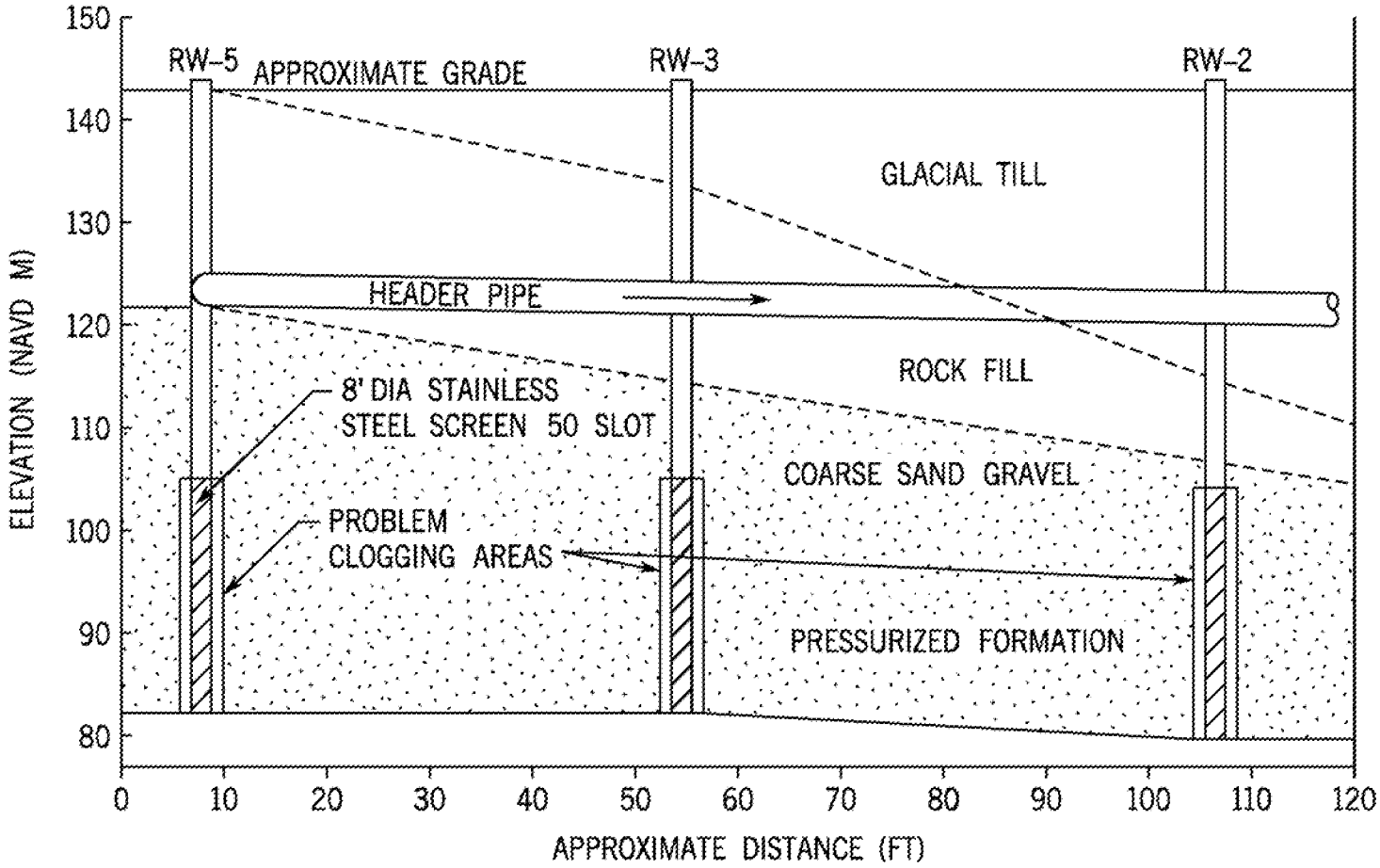
FIG. 5B illustrates a cross-section of the subsurface strata and three relief wells corresponding to FIG. 5A.

FIG. 5B illustrates a cross-section of the subsurface strata and three relief wells corresponding to FIG. 5A. The existing relief wells and piezometers at the Powerhouse are screened in a confined sand-and-gravel aquifer below a low permeability glacial till stratum. The aquifer exhibited up to 25 feet of artesian pressure above the Powerhouse floor prior to installing the relief wells. The three 8-inch-diameter relief wells, spaced some 55 feet apart, were similarly constructed, each averaging about 58 feet in depth, with 60-slot Stainless Steel screen lengths from 23 to 25 feet within a 15-inch-diameter borehole. The wells are connected to a subsurface horizontal header pipe, located approximately 20 feet below surface grade upstream of the Powerhouse, and about 5 feet below the Powerhouse floor. The header pipe serves to collect the artesian discharge from the wells and directs that water to a weir (for flow measurement) before discharging to the Hoosic River.

Since the installation of the relief wells, two interrelated and simultaneous phenomena have been observed at the Powerhouse: 1.) Pore-water pressures beneath the Powerhouse have gradually increased to levels approaching the Design Basis Value for the structure; while 2.) Flow rates of relief well discharge to the weir have slowly declined. Both are undesirable conditions.

Figure 6:
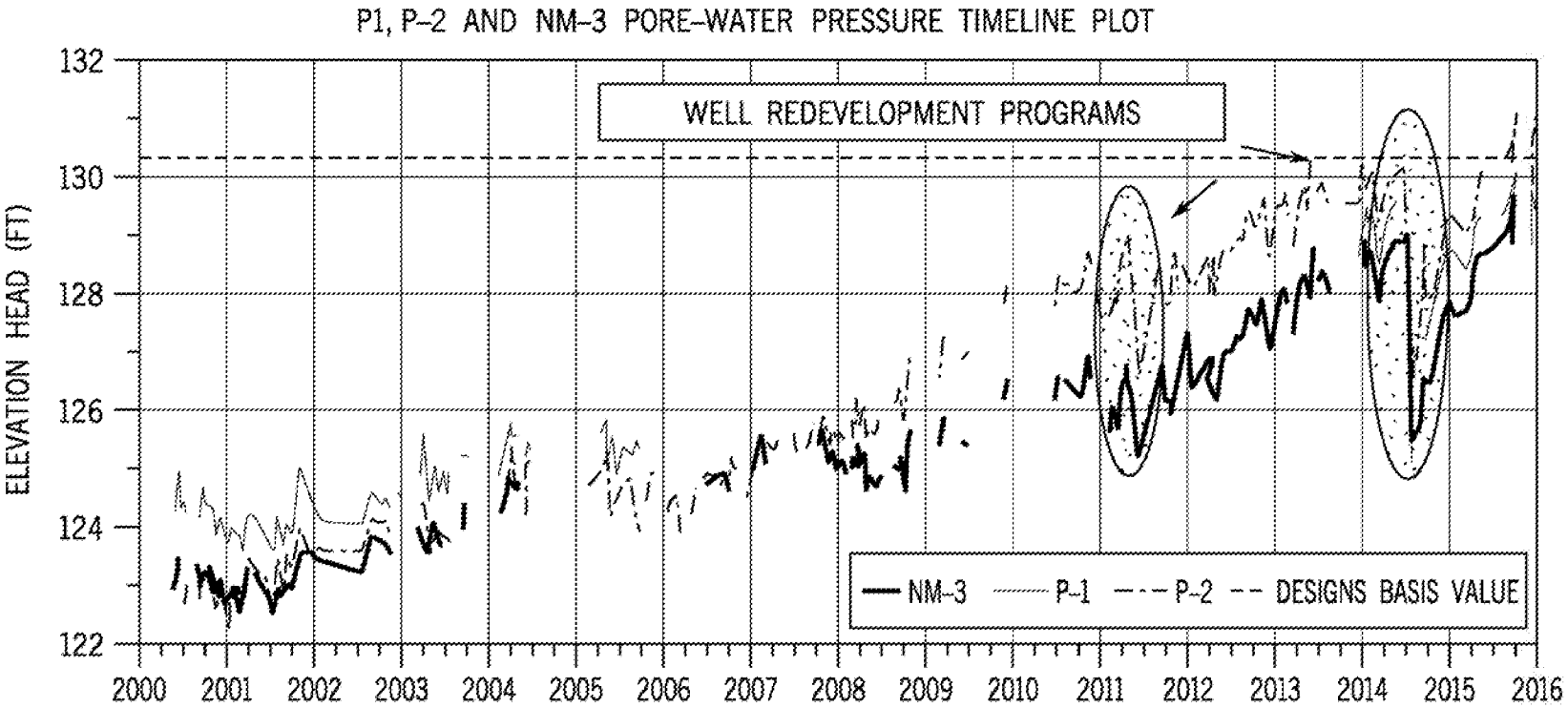
FIG. 6 illustrates failed attempts at reducing pore-water pressure for the relief wells of FIG. 5B.

FIG. 6 illustrates failed attempts at reducing pore-water pressure for the relief wells of FIG. 5A and FIG. 5B. Monthly pore-water pressure readings vs. time plots (FIG. 6) for VWPs P-1, P-2, and NM-3 illustrate the gradual, but consistent, increase in the elevation head since the relief wells were installed in 1999. By mid-2014, the pore-water pressure data indicated that all three VWPs had reached or exceeded the upper Design Basis Value required to maintain an acceptable safety factor.

The two vertical purple ellipses on FIG. 6 reflect re-development efforts performed in 2011 and 2014 (which utilized old existing methods at the time) in an attempt to restore flow to the relief wells and, in turn, reverse the trend of increasing pore-water pressures beneath the Powerhouse. Neither of which were effective long term. These data illustrate that the traditional redevelopment efforts, no matter how effective in the short term, were not providing a practical long-term solution to well clogging as illustrated by the increasing elevation head with time plotted in FIG. 6. Concurrent with the increasing pore-water pressures, the weir flow rate data indicated a decline in the combined volume of discharge of the relief wells from around 150 gallons per minute (gpm) in 2000 to around 48 gpm by 2014.

An outcome of the 2014 program was the discovery that evacuated formation material from just outside the relief well screens was being recovered in the re-development water, which led to the conclusion that the repeated aggressive redevelopment method using over-pumping with surge blocks was eroding the well gravel pack, resulting in damage to the wells. The old method of over-pumping with surge blocks entails using a surface mounted mechanism to move a surge block(s) in an oscillatory motion over a discrete section of well screen while pumping from the discrete section isolated by a rubber surge block(s)(swab) on a repeated basis to hydraulically disturb the formation immediately outside the well screen while the well continues to flow. During the old method of over-pumping with a surge block(s), flow to the well is momentarily reversed as a result of the oscillatory surge block motion. During the old method of over-pumping with surge blocks develops aggressive hydraulic action that can cause some wells to deteriorate as observed in the 2014 program.

These problems with the relief wells at the Powerhouse were solved by utilizing a GFRD system according to embodiments of the invention. In the various embodiments, well packers and naturally occurring groundwater pressure gradients were used to purge the wells. Note, in this description of embodiments, naturally occurring pressure is defined as the ambient groundwater pressure absent the presence of the relief well system. Control of pore-water pressures at the Powerhouse, consisted of a Phase I Trial followed by the design and installation of an Automated Packer-Purge System (System).

Figure 7:
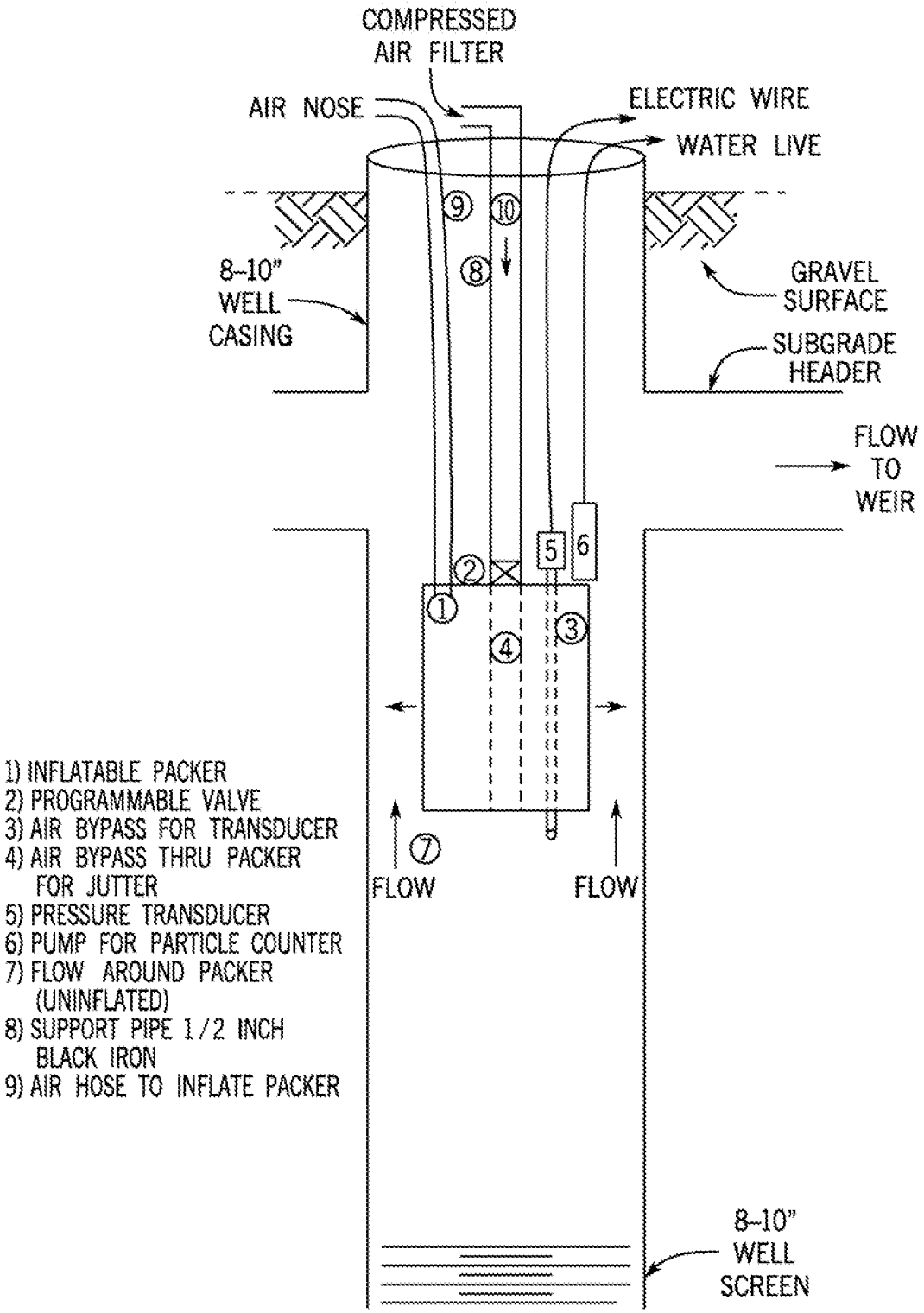
FIG. 7 illustrates an equipment configuration for installation in a relief-well according to embodiments of the invention.

FIG. 7 illustrates an equipment configuration for installation in a relief well according to embodiments of the invention. With reference to FIG. 7, the in-well equipment configuration of the System is illustrated. The in-well equipment of FIG. 7 can be placed at a depth ranging from just above the well screen to just below the header pipe (FIG. 5B).

Phase I Trial of Packer-Purge System at Schaghticoke

The GFRD systems were installed into the three Powerhouse relief wells and were designed and constructed to provide intermittent surging of the relief wells using natural gradients that could remove (purge) clogging particles and restore well yield, thus reducing pore-water pressures. The GFRD System was designed to accomplish the following:

1. Halt the flow in the respective wells, either individually or in combination (depending on the resultant pressure response), by inflating a packer.
2. Allow a pressure condition to stabilize beneath each inflated packer. The amount of pressure that builds up will depend on the method being used (described below).
3. Release the packers to create an instantaneous surge into each well, thereby purging particles from the well bore, and restoring flow to the well.

Referring to FIG. 7, each packer (GFRD) assembly was outfitted with the following:

a. An inflatable packer and appurtenances to inflate the packer via an air compressor.
b. A pressure recording transducer situated below the packer to measure water pressure response when the packer was inflated.
c. A submersible pump to remove water above the inflated packer.
d. A manifold to direct and control air flow into and out of each packer assembly.

In one non-limiting embodiment, provided merely for example, the packer used was a model 265068 Muni-Ball Plug made by Cherne. In various embodiments, a GFRD device stops the flow of groundwater through the well and permits remote control of the release of the flow thereby permitting the restoration of the flow. Well pressures typically range) from 3 to 10 pounds per square inch (psi) for most wells, though higher pressures can be encountered in unique hydrologic settings with very high pressure gradients.

The Packer-Purge System was tested in each relief well under three different methods of packer-purging (listed below in order of least aggressive to most aggressive method):

1. Static Packer-Purging (Static Purging)—Wherein an inflated packer halts the flow in the well (through packer inflation) and then instantaneously releases it.
2. Air Surging (Juttering)—Air is surged through a bypass in the inflated packer, thereby pushing the water column several feet down the well.
3. Pump Assisted Purging (Pump Evacuation)—Natural pore-water pressures are maximized as a result of removing (via pumping) water above the packer before release. Note that this is a pumping of water out of the well casing above the packer before the packer is released. It is not a pumping of water while the packer is released.

Once outfitted, the relief wells were then run through a systematic series of packer-purging tests, both individually and in combination, to evaluate the individual and collective response of the wells to the packer-purging methods. Data on transducer pressures, particle counts, and flow rates at the weir were collected throughout the Trial.

Results of Phase I Trial of the Packer-Purge System

During the three-day Phase I Trial, each of the Packer-Purge System methods of well purging yielded positive results, in varying degrees, as observed in three critical areas:

1) Reducing pore-water pressures in the aquifer beneath the Powerhouse;

2) Restoring measurable flow to the weir; and

3) Removing particles from the well bore.

The net results and impact of the Phase I Trial in these three areas are described below.

A. Pore-Water Pressure Reduction

Figure 8:
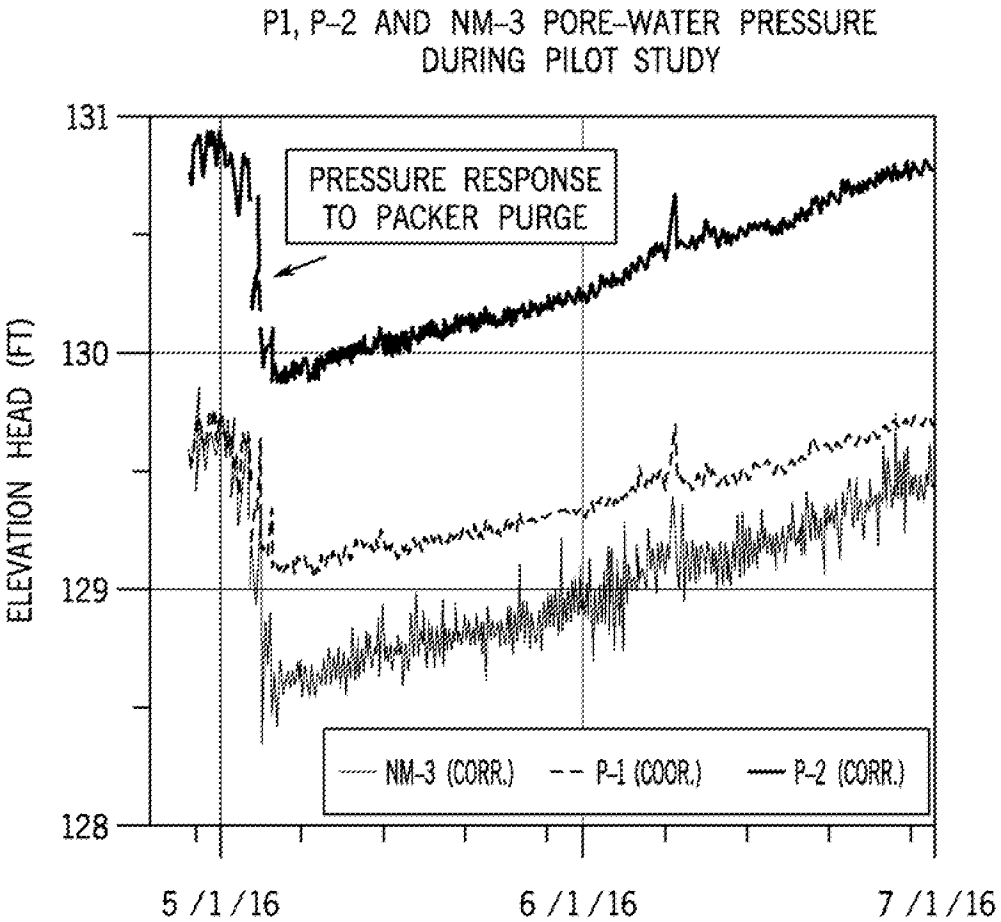
FIG. 8 illustrates pore-water pressure measurements in the relief wells of FIG. 6, according to embodiments of the invention.

FIG. 8 illustrates pore-water pressure measurements in the relief wells of FIG. 6, according to embodiments of the invention. The plot in FIG. 8 illustrates the pore-water pressures recorded in the VWPs (corrected for barometric pressure) before, during, and after the time of the Trial.

An overall reduction in pore-water pressures of approximately one foot on average was measured by VWPs P-1, P-2, and NM-3. Following the end of the Trial, the pore-water pressures measured by the respective VWPs were below Design Basis Value and comparable to pressures realized in and around 2012. The return to gradually increasing pore-water pressures following the Trial is evident in the right-side of the Figure. As a result, an Automatic Packer-Purge System was constructed to provide ongoing control of pore-water pressures.

B. Flow to the Weir

Over the course of the three-day Trial, flow across the weir increased from a starting point of approximately 48 gpm before packer purging was initiated to approximately 53 gpm post-packer purging. This increase in flow over the Trial period showed a positive impact of the System's methodology.

C. Particle Removal from the Relief Wells

Figure 9:
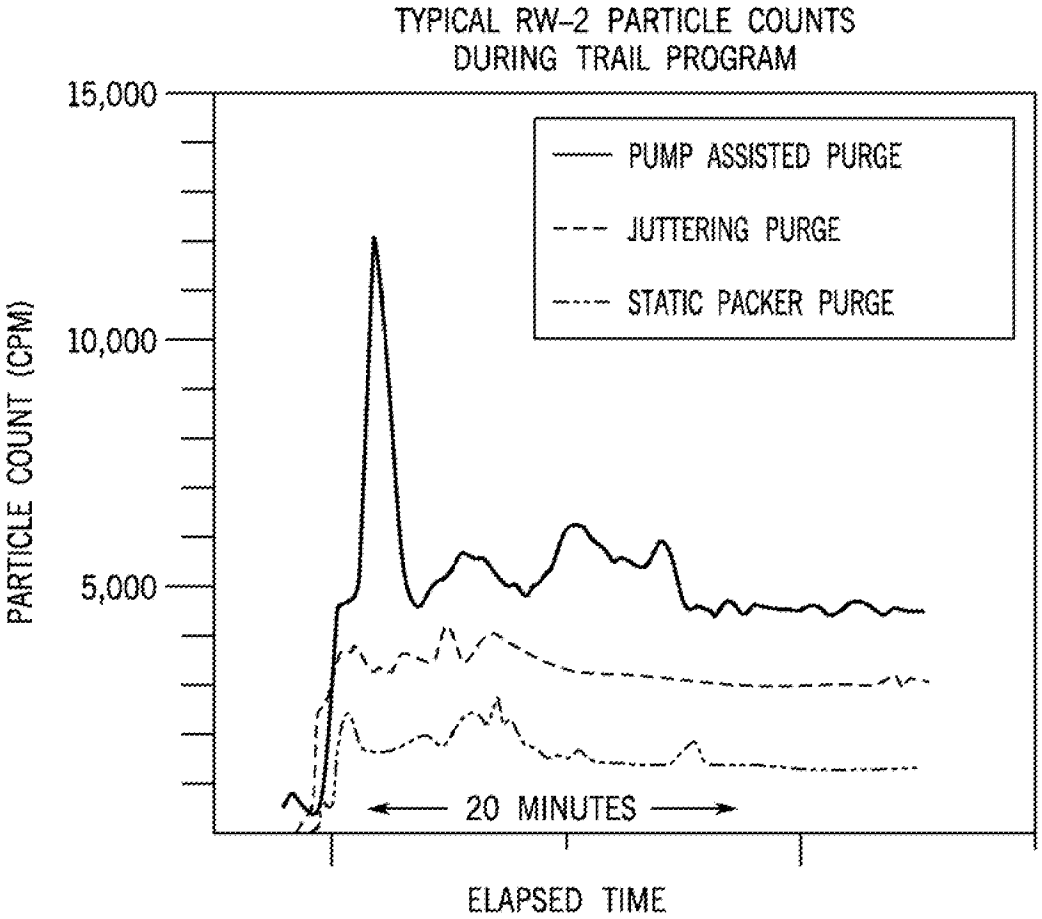
FIG. 9 illustrates particle removal, according to embodiments of the invention.

FIG. 9 illustrates particle removal, according to embodiments of the invention. With reference to FIG. 9, a plot of the particle counts per minute for relief well RW-2 as a result of the three packer-purging methods applied to the well during the Trial is illustrated. (Note, the other two relief wells responded with similar particle count patterns during each of the purging methods.) The lower left-hand corner of the plot indicates that under pre-purging conditions (i.e. normal well operation) total particle counts in the wells ranged from only 40 to 90 counts per minute (cpm). Such a low value is indicative of a clogged well. Immediately following a packer-purging event (when the most particles are being removed from the well) particle removal rates ranged from 3,000 cpm as a result of the Static Packer Purge (least aggressive) to around 12,000 cpm as a result of the Pump Assisted Purge (most aggressive). As expected, the more aggressive purging methods produced a greater reduction in pore-water pressure and a greater increase in flow to the weir. These data indicate that the use of naturally occurring hydraulic gradients can be an effective means of mobilizing particles from the well bore and thus reducing well clogging.

Finally, as previously mentioned, in the 2014 well redevelopment program, formation materials were being evacuated from the well bore, potentially creating voids in the gravel pack. In contrast, upon completion of the Phase I Trial, no sediment had accumulated in the well sumps as a result of the cumulative Packer-Purging Methods applied during the Trial.

This difference in outcomes between the 2014 pumping program and the Phase I Trial is important because it confirms that while clogging particles are clearly being removed from the well bore via the Packer-Purge System, the well gravel pack is not being mobilized, thus maintaining integrity of the well bore. As a result, the System is non-destructive and therefore a more sustainable method of well purging than the old method of over-pumping with surge blocks.

Automated Packer-Purge System Installation, Operations and Preliminary Results

Following the Phase I Trial, an Automated Packer-Purge System was designed and installed to lower and then continuously maintain the desired pore-water pressures, thereby achieving foundation stability in the long term.

A. Automated Packer-Purge System Design and Installation

Figure 10:
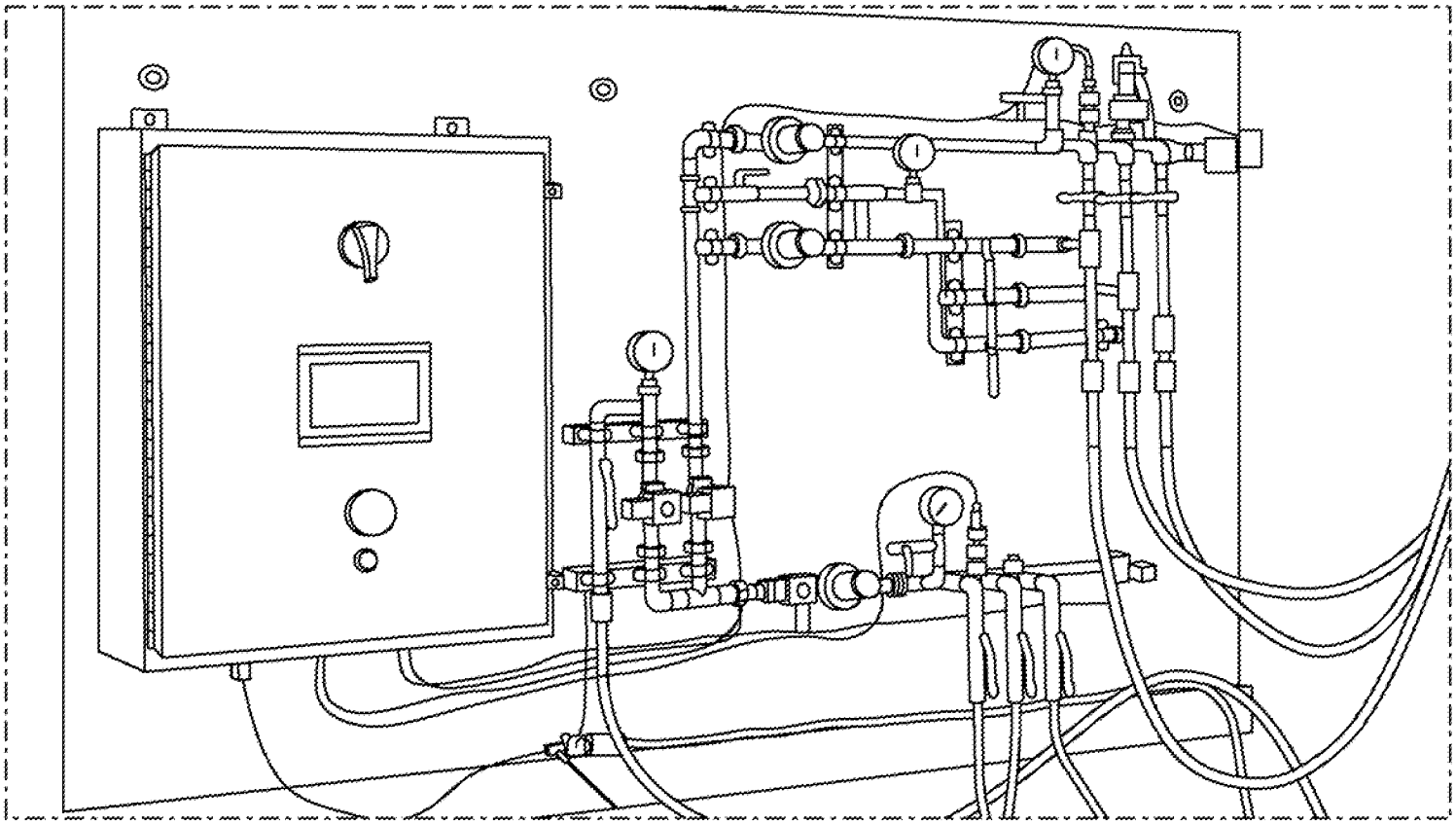
FIG. 10 illustrates a system for pore-water pressure modulation, according to embodiments of the invention.

FIG. 10 illustrates a system for pore-water pressure modulation, according to embodiments of the invention. An Automated Packer-Purge System was installed at the Schaghticoke Development Powerhouse. The System, illustrated in FIG. 10, consists of an Allen Bradley Human Machine Interface (HMI) programmed to 1) Operate the automatic valves on the manifold that control the flow of compressed air, and 2) Regulate the packer-purging method air pressures. The flow of compressed air is directed through the manifold into the well packers to operate the three Packer-Purge System methods discussed earlier. Air relief valves on the manifold allow for instantaneous release of compressed air. Manual valves allow for the relief wells to be operated independently, should purging of individual wells be necessary.

The Program Logic control (PLC) was designed to allow for the ability to 1) Select the type of packer-purging method, 2) Schedule the frequency of the method, and 3) Control the intensity of each method. For example, multiple back-to-back-purges (halting and releasing the flow to the well in rapid succession) are considered a more intense purging method than a single daily purging event.

Packer Inflation Safety Precautions: To ensure that packers cannot stay inflated for periods longer than programmed, i.e., eliminating the potential for the relief wells to remain pressurized for longer than programmed intervals, redundant safety routines are built into the PLC, including: Packer-Purge method timers, fail safe "Open" valves (in the event of power loss), and audible alarms. The PLC records data from each packer-purge event on a Subscriber Identification Module (SIM) card so that the Automated System operations can be tracked and analyzed.

B. Automated Packer-Purge System Operation and Preliminary Results

The operation of the Automated Packer-Purge System began in Static Purge with one purging cycle each day simultaneously in all three wells to gently initiate the particle purging process. Over time, multiple back-to-back purges were programmed to increase the purging intensity. Pore-water pressure readings from the VWPs were downloaded weekly to assess the ability of the Automated Packer-Purge System to maintain desirable pressures.

Figure 11:
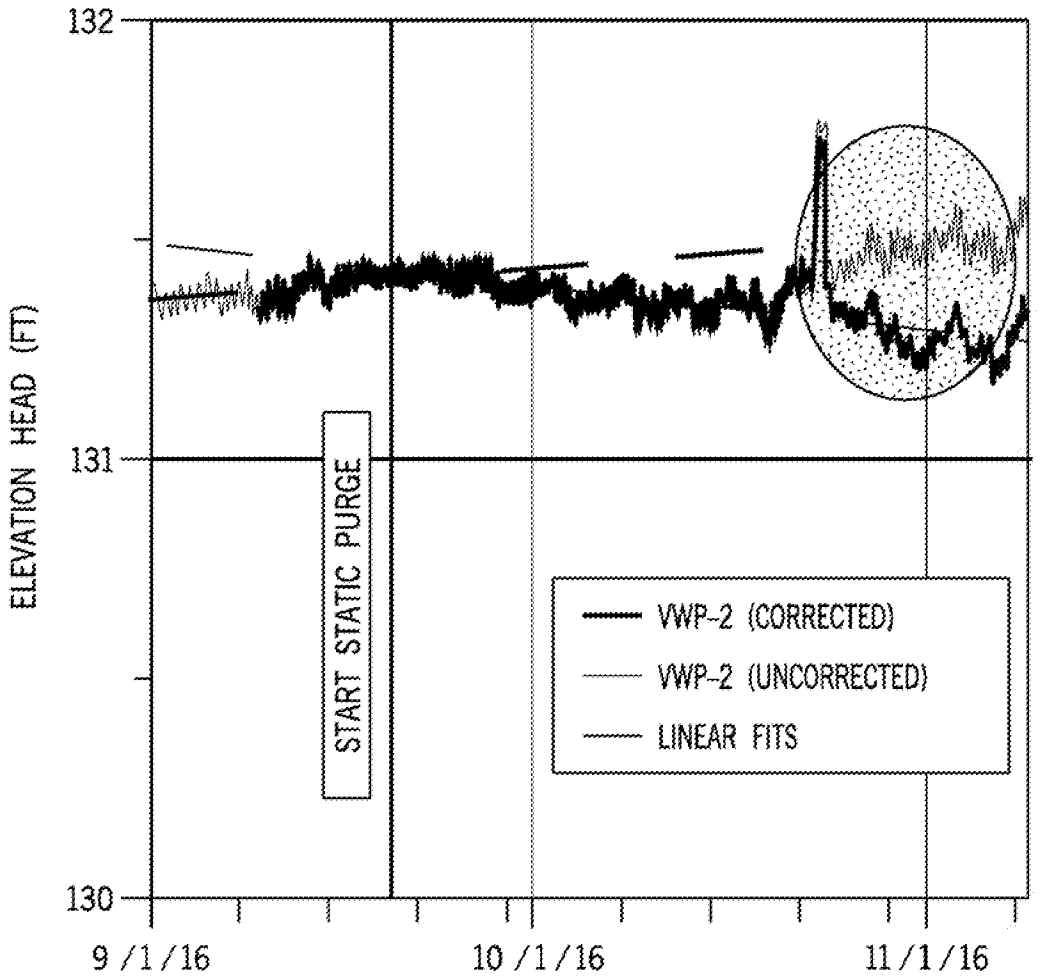
FIG. 11 illustrates a comparison of pore-water pressure modulation, according to embodiments of the invention.

FIG. 11 illustrates a comparison of pore-water pressure modulation, according to embodiments of the invention. With reference to FIG. 11, the pore-water pressure trends in VWP-2 observed over the period of Static Purge operation is illustrated.

The blue-trend line illustrates the gradual increase in pore-water pressure prior to the start-up of the Automated System, followed by the green-trend line illustrating the gradual decrease in the pressure gradient upon initialization of the Automated System. Note, the trend in decreasing pore-water pressure was interrupted by a series of rainfall events that raised the tail-water elevation, resulting in a significant increase in pressures in the VWPs (the grey line in the yellow highlighted area). These data indicate that the tail-water elevation directly impacts pore-water pressures at the relief wells. Accordingly, the VWP data was corrected, thereafter, to compensate for this relationship and allow for a continuous evaluation of the Automated System's performance. The red line on the right side of the plot illustrates the data corrected for tail-water elevation. Overall, a month of Static Purge operation served to 1) Reverse the long-term trend in increasing pore-water pressures and 2) Reduce pore-water pressures in all VWPs (based on corrected data by around 0.3 feet).

Figure 12:
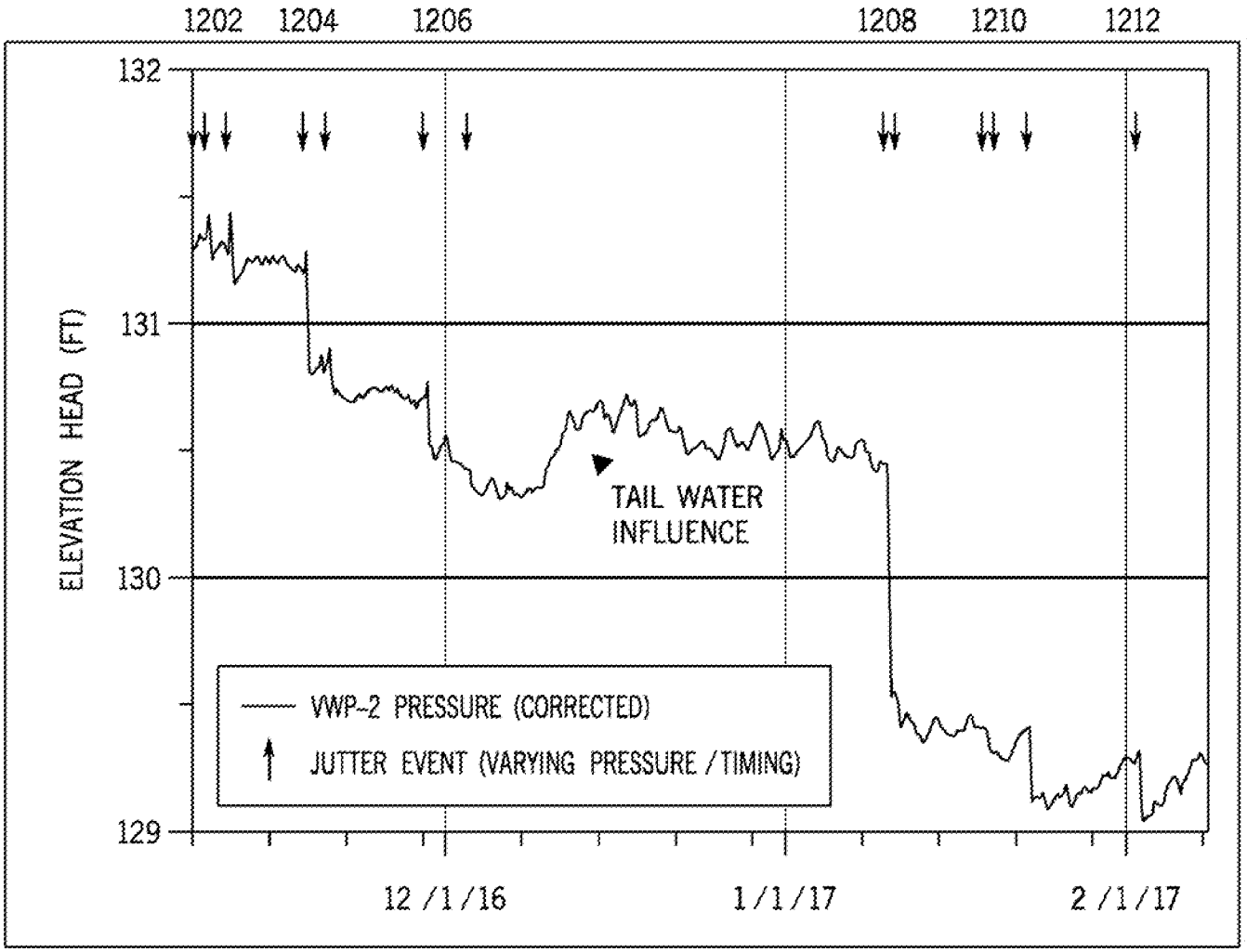
FIG. 12 illustrates the impact of Juttering on pore-water pressure, according to embodiments of the invention.

FIG. 12 illustrates the impact of Juttering on pore-water pressure, according to embodiments of the invention. In late October 2016, the Packer-Purge System was switched to Juttering, again employing a single purge of low pressure to initiate the program. Juttering pressures and schedules were gradually increased over time e.g., 1202, 1204, 1206, 1208, 1210, and 1212 to achieve greater pore-water pressure reductions. As previously observed during the Phase I Trial, there was an increase in flow to the weir along with each reduction in pore-water pressure. FIG. 12 illustrates the pore-water pressure trends observed in VWP-2 from October 2016 through March 2017 resultant from Juttering.

As illustrated on the right-hand side of the Figure, the gradual increase in Juttering intensity generated a succession of significantly larger downward steps in pore-water pressure. Ultimately, a reduction in pore-water pressure of nearly one (1) foot was observed as a result of a single Juttering event 1208, far outstripping the impact of the Static Purge Method. The event represented at 1208 was two individual purge cycles spaced one day apart with a pressure discontinuity ($\Delta P$) having a magnitude approximately equal to ten (10) feet of hydraulic head.

C. Comparing the Automated Packer-Purge System to Previous Relief Well Redevelopment Programs FIG. 13 illustrates a comparison of pore-water pressure reduction methods with embodiments of the invention. FIG. 13 presents a summary of the key findings from the 2016 Pilot Program and compares them with the results of the 2011 and 2014 relief well redevelopment programs, both of which failed to be feasible for long term use.

The data reveal that the Packer-Purge System accomplished comparable improvements in pressure reduction and weir flow when compared to the more aggressive redevelopment programs of 2011 and 2014. Equally important, the effects of the Packer-Purge System are 1) long-lasting (due to repeated operation) and 2) absent gravel-pack erosional issues using the three Packer-Purge System methods. As discussed, gravel pack erosion leads to well inefficiency and, in the worst case, well or formation collapse.

D. Permanent Installation of Automated Packer-Purge System

Once all pore-water pressures were reduced some 2.7 feet below pre-Static Purge conditions, the Automated Packer-Purge System was taken offline and retrofitted to become a permanent installation, including PLC code efficiencies, new air hoses and encasements, well head installations (to withhold uplift pressures) and some stainless steel downhole replacement parts. In June 2017, the Automated System went back online in Juttering Mode, and, to date, continues to control relief well pore-water pressures at the Powerhouse and support flow to the weir.

E. System Operation

The composition of subsurface soils where relief wells are located can vary from one location to another. Accordingly, the GFRD System is configured to select a groundwater flow interruption profile that is optimized for a given location. Such an optimization begins by running a test profile with the goal of establishing the technique or combination of techniques that are most effective at removing clogging particles from the well bore, in turn, reducing pore-water pressure in the subsurface stratigraphy for the given location. In one embodiment, the Static Purge technique is implemented for a first interval of time, with a first purge frequency, followed by the Juttering technique for a second interval of time, with a second purge frequency, followed by the Pump Evacuation technique for a third interval of time, with a third purge frequency. The reductions in pore-water pressure (head elevation) accomplished from each of the techniques are compared. Particle counter data is evaluated, a purge frequency or frequencies can be adjusted, a magnitude of a pressure discontinuity used in a given technique can be adjusted, and the technique producing the largest reduction in pore-water pressure is selected and implemented as the technique that is employed for the relief well location under test. Other data, such as sediment transport from gravel pack erosion can be used in the algorithm employed to select a technique for operating the system at a given location.

In other embodiments, the optimization method described above can be modified by mixing the three techniques within a first interval of time, with the same or different purge frequencies used for each technique. Another mixing of techniques can be employed in the second interval of time and so on. Where the reduction in pore-water pressure obtained for each time interval is compared and a selection of a technique is made based on the results of comparison of system performance over the time intervals. Other data, such as sediment transport from gravel pack erosion can be used in the algorithm employed to select a method for operating the system at a given location. With the three technique described herein there are six (6) combinations of the three technique that the system can test while seeking the optimized combination for a given location. Introduction of purge frequency as a variable increases the combination of techniques accordingly.

In some embodiments, a depth of the in-well equipment (e.g., the packer) can be varied along with the sequence of technique described above while seeking to obtain the optimal groundwater flow interruption profile that is optimized for a given location.

In one non-limiting embodiment, provided for illustration a packer is installed in a well to the desired depth above the well screen and inflated thereby halting groundwater flow. The time to stabilize or halt the flow can vary depending on the transmissivity of the formation. Some formations stabilize in approximately one minute other formations take more or less time to stabilize. In one non-limiting example of the Juttering method, the packer is inflated, stabilization occurs and then air is released below the packer—constituting one purge cycle. This can be repeated multiple times from one (1) time to up to many dozens of times (per purge event) depending on the soil stratigraphy. In one or more embodiments, eight (8) Juttering cycles are performed per purge event. Particle counter information is factored into the operation schema for the given well based on the construction of a purge event and the frequency of the purge events. Low mobilization of particles calls for increased energy into the well and thus an increased number of cycles per purge event or an increased frequency of purge events. Frequency of purge events can vary from multiple times a day to multiple days separating the purge events. In some embodiments, purge events occur every 10 days and each purge event can include one (1) or more purge cycle of a given method.

In some embodiments, it is more effective to space out the purge events instead of performing multiple purge events in the same twenty-four (24) hour period of time. For example, in the Powerhouse wells described above, the purge events occur every 10 days with nine (9) cycles of purging performed in one purge event.

SUMMARY AND CONCLUSIONS

The positive impacts noted above demonstrate that taking advantage of natural gradients when purging relief wells serves as a viable long-term strategy to maintain flow rates to the weir and keep pore-water pressures below the Design Basis Value. Equally important is the fact that low-gradient well purging does not generate erosion or disturbance of the well-screen gravel-pack area, which has the added advantage of maintaining the wells in the long-term. Finally, only hand tools are required to install or inspect the System so costs are reduced in comparison to traditional well redevelopment techniques and there are no overhead restrictions.

At every dam/powerhouse site, safety is the overriding goal. The Packer-Purge System to date has been proven to be more than the quick fix offered by traditional old well redevelopment. The System provides a tool for reducing relief well clogging, lowering of pore-water pressures, and is a sustainable strategy for long-term relief well maintenance.

Figure 14:
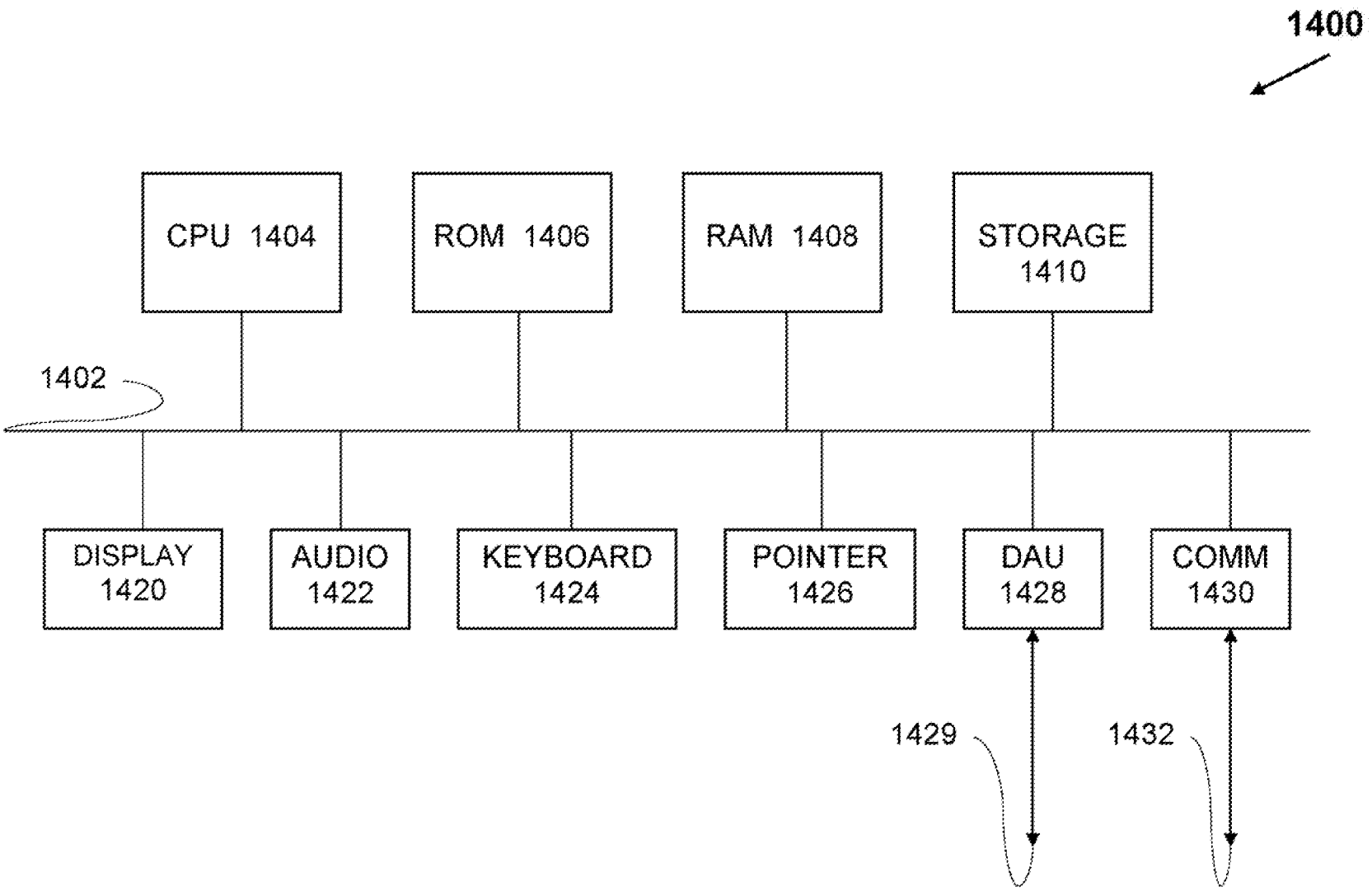
FIG. 14 illustrates an automated system in which embodiments of the invention may be used.

FIG. 14 illustrates an automated system in which embodiments of the invention may be used. The block diagram is a high-level conceptual representation and may be implemented in a variety of ways and by various architectures. With reference to FIG. 14, bus system 1402 interconnects a Central Processing Unit (CPU) 1404, Read Only Memory (ROM) 1406, Random Access Memory (RAM) 1408, storage 1410, display 1420, audio 1422, keyboard 1424, pointer 1426, data acquisition unit (DAU) 1428, and communications 1430. The bus system 1402 may be for example, one or more of such buses as a system bus, Peripheral Component Interconnect (PCE), Advanced Graphics Port (AGP), Small Computer System Interface (SCSI), Institute of Electrical and Electronics Engineers (IEEE) standard number 1394 (FireWire), Universal Serial Bus (USB), or a dedicated bus designed for a custom application, etc. The CPU 1404 may be a single, multiple, or even a distributed computing resource or a digital signal processing (DSP) chip. Storage 1410 may be Compact Disc (CD), Digital Versatile Disk (DVD), hard disks (D), optical disks, tape, flash, memory sticks, video recorders, etc. The system 1400 is configured and used to control the groundwater flow Regulating Device (GFRD) system. Note that depending upon the actual implementation of the system, the system may include some, all, more, or a rearrangement of components in the block diagram. In some embodiments, aspects of the system 1400 are performed in software. While in some embodiments, aspects of the system 1400 are performed in dedicated hardware such as a digital signal processing (DSP) chip 1440, or a system on a chip (S(X) which can also be represented at 1440, etc. as well as combinations of dedicated hardware and software as is known and appreciated by those of ordinary skill in the art.

Thus, in various embodiments, data is received at 1429 for processing by the system 1400. Such data can be transmitted at 1432 via communications interface 1430 for further processing in a remote location. Connection with a network, such as an intranet or the Internet is obtained via 1432, as is recognized by those of skill in the art, which enables the system 1400 to communicate with other data processing devices or systems in remote locations. Following processing or analyzing the data in the remote location instructions can be sent back to a system to adjust parameters associated with the system that is controlling purge cycles executing on one or more wells.

For example, embodiments of the invention can be implemented on a computer system 1400 configured as a desktop computer or work station, on for example a WINDOWS® compatible computer running operating systems such as WINDOWS® XP Home or WINDOWS® XP Professional, WINDOWS® 10 Home or WINDOWS® 10 Professional, Linux, Unix, etc. as well as computers from APPLE COMPUTER, Inc. running operating systems such as OS X, etc. Alternatively, or in conjunction with such an implementation, embodiments of the invention can be configured with devices such as speakers, earphones, video monitors, etc. configured for use with a Bluetooth communication channel. In yet other implementations, embodiments of the invention are configured to be implemented by mobile devices such as a smart phone, a tablet computer, or the like.

In various embodiments, the components of systems described in the previous figures are implemented in an integrated circuit device, which may include an integrated circuit package containing the integrated circuit. In some embodiments, the components of systems as well as the systems are implemented in a single integrated circuit die. In other embodiments, the components of systems as well as the systems are implemented in more than one integrated circuit die of an integrated circuit device which may include a multi-chip package containing the integrated circuit.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized, and that logical, mechanical, electrical, and other changes may be made without departing from the scope of the present invention.

Some portions of the description may be presented in terms of algorithms and symbolic representations of operations on, for example, data bits within a computer memory. These algorithmic descriptions and representations are the means used by those of ordinary skill in the data processing arts to most effectively convey the substance of their work to others of ordinary skill in the art. An algorithm is here, and generally, conceived to be a self-consistent sequence of acts leading to a desired result. The acts are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, waveforms, data, time series or the like.

It should be borne in mind, however, that these and similar terms are to be associated with the appropriate physical quantities and are merely convenient labels applied to these quantities. Unless specifically stated otherwise as apparent from the discussion, it is appreciated that throughout the description, discussions utilizing terms such as "processing" or "computing" or "calculating" or "determining" or "displaying" or the like, can refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

An apparatus for performing the operations herein can implement the present invention. This apparatus may be specially constructed for the required purposes, or it may comprise a general-purpose computer, selectively activated or reconfigured by a computer program stored in the computer. Such a computer program may be stored in a computer readable storage medium, such as, but not limited to, any type of disk including floppy disks, hard disks, optical disks, compact disk read-only memories (CD-ROMs), and magnetic-optical disks, read-only memories (ROMs), random access memories (RAMs), electrically programmable read-only memories (EPROM)s, electrically erasable programmable read-only memories (EEPROMs), FLASH memories, magnetic or optical cards, etc., or any type of media suitable for storing electronic instructions either local to the computer or remote to the computer.

The algorithms and displays presented herein are not inherently related to any particular computer or other apparatus. Various general-purpose systems may be used with programs in accordance with the teachings herein, or it may prove convenient to construct more specialized apparatus to perform the required method. For example, any of the methods according to the present invention can be implemented in hard-wired circuitry, by programming a general-purpose processor, or by any combination of hardware and software. One of ordinary skill in the art will immediately appreciate that the invention can be practiced with computer system configurations other than those described, including hand-held devices, multiprocessor systems, microprocessor-based or programmable consumer electronics, digital signal processing (DSP) devices, network PCs, minicomputers, mainframe computers, and the like. Embodiments of the invention can also be practiced in distributed computing environments where tasks are performed by remote processing devices that are linked through a communications network. In other examples, embodiments of the invention as described in the figures above can be implemented using a system on a chip (SOC), a digital signal processing (DSP) chip, or in other implementations of hardware and software.

The methods of the invention may be implemented using computer software. If written in a programming language conforming to a recognized standard, sequences of instructions designed to implement the methods can be compiled for execution on a variety of hardware platforms and for interface to a variety of operating systems. In addition, the present invention is not described with reference to any particular programming language. It will be appreciated that a variety of programming languages may be used to implement the teachings of the invention as described herein. Furthermore, it is common in the art to speak of software, in one form or another (e.g., program, procedure, application, driver, . . . ), as taking an action or causing a result. Such expressions are merely a shorthand way of saying that execution of the software by a computer causes the processor of the computer to perform an action or produce a result.

It is to be understood that various terms and techniques are used by those knowledgeable in the art to describe communications, protocols, applications, implementations, mechanisms, etc. One such technique is the description of an implementation of a technique in terms of an algorithm or mathematical expression. That is, while the technique may be, for example, implemented as executing code on a computer, the expression of that technique may be more aptly and succinctly conveyed and communicated as a formula, algorithm, mathematical expression, flow diagram or flow chart. Thus, one of ordinary skill in the art would recognize a block denoting A+B=C as an additive function whose implementation in hardware and/or software would take two inputs (A and B) and produce a summation output (C). Thus, the use of formula, algorithm, or mathematical expression as descriptions is to be understood as having a physical embodiment in at least hardware and/or software (such as a computer system in which the techniques of the present invention may be practiced as well as implemented as an embodiment).

Non-transitory machine-readable media is understood to include any mechanism for storing information in a form readable by a machine (e.g., a computer). For example, a machine-readable medium, synonymously referred to as a computer-readable medium, includes read only memory (ROM); random access memory (RAM); magnetic disk storage media; optical storage media; flash memory devices; except electrical, optical, acoustical or other forms of transmitting information via propagated signals (e.g., carrier waves, infrared signals, digital signals, etc.); etc.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. A system to reduce a pore-water pressure of water within a subsurface formation below a first pressure, comprising:

a ground water flow regulating device (GFRD), the GFRD is inserted to a depth within a well casing, wherein the GFRD is used to create a sequence of events in the following order, the sequence of events constitutes a first purge cycle as follows:

a. activation of the GFRD to create a pressure discontinuity across a length of the GFRD for a first period of time, which causes local pore-water pressure below the GFRD to increase; and b. deactivation of the GFRD to release the pressure discontinuity after the first period of time under local pore-water pressure, wherein local pore-water pressure decreases from the first pressure to a second pressure after the release and the second pressure is less than the first pressure, thereby increasing ground water flow in the well casing.

2. The system of claim 1, wherein a technique used for the first purge cycle is selected from the group consisting of static purge, air surge, and evacuation.

3. A method to reduce a pore-water pressure of water within a subsurface formation below a first pressure, comprising:

activating a ground water flow regulating device (GFRD) to create a pressure discontinuity in a well for a first period of time, such that during the activating, the GFRD restricts ground water flow through the well, which causes local pore-water pressure below the GFRD to increase; and deactivating the GFRD to release ground water flow after the first period of time under local pore-water pressure, wherein local pore-water pressure decreases to a second pressure after the deactivating and the second pressure is less than the first pressure, wherein a first purge cycle is concluded with the deactivating.

4. The method of claim 3, wherein a magnitude of the pressure discontinuity is increased by injecting air into the well casing to lower a water level in the well casing.

5. The method of claim 3, wherein a magnitude of the pressure discontinuity is increased by evacuating water from above the GFRD.

6. The method of claim 3, the first purge cycle is the static purge technique.

7. The method of claim 3, wherein a technique used for the first purge cycle is selected from the group consisting of static purge, air surge, and evacuation.

8. A system to reduce a pore-water pressure within a subsurface formation below a first pressure, comprising:

a ground water flow regulating device (GFRD), the GFRD is inserted to a depth within a well casing, wherein the GFRD is used to create a sequence of events in the following order, the sequence of events constitutes a first purge cycle as follows:

activation of the GFRD to create a pressure discontinuity across a length of the GFRD for a first period of time, the pressure discontinuity is created in part by injecting gas into a well to lower a water level in the well casing, which causes local pore-water pressure below the GFRD to increase;

deactivation of the GFRD to release the gas from the well casing after the first period of time under local pore-water pressure, when ground water flow resumes following the release, local pore-water pressure is reduced to a second pressure, the second pressure is less than the first pressure.

9. The system of claim 8, wherein the GFRD includes a particle counter, the particle counter to measure particles as a function of time, a number of particles measured during the first purge cycle is used to select a magnitude of the pressure discontinuity for use in a subsequent purge cycle.

10. The system of claim 8, wherein the water level is lowered to an elevation between a bottom of the GFRD and a top of a well screen attached to the well casing.

11. The system of claim 10, wherein the gas does not enter the subsurface formation.

12. The system of claim 8, wherein the gas does enter the subsurface formation and the gas is an inert gas that does not contain oxygen.

13. The system of claim 8, wherein a second period of time separates the first purge cycle from a second purge cycle and the second period of time is selected to maximize a reduction in the pore-water pressure.

14. The system of claim 13, wherein the second period of time is approximately 10 days.

15. A method to reduce a pore-water pressure within a subsurface formation below a first pressure, comprising:

activating a ground water flow regulating device (GFRD) to create a pressure discontinuity in a well for a first period of time, the activating causes local pore-water pressure in the well to increase;

lowering a water level in the well by injecting a gas into the well beneath the GFRD; and deactivating the GFRD to release the gas from the well after the first period of time, the deactivating occurs under local pore-water pressure, when ground water flow resumes following the deactivating, local pore-water pressure decreases to a second pressure after the deactivating and the second pressure is less than the first pressure, wherein a first purge cycle is concluded with the deactivating.

16. A method to reduce a pore-water pressure within a subsurface formation below a first pressure, comprising:

activating a ground water flow regulating device (GFRD) to create a pressure discontinuity in a well for a first period of time, during the activating the GFRD restricts water flow through the well and local pore-water pressure beneath the GFRD increases;

lowering a water level in the well by injecting a gas into the well beneath the GFRD; and deactivating the GFRD to release the gas from the well, after the first period of time under local pore-water pressure, when ground water flow resumes following the deactivating, local pore-water pressure decreases to a second pressure and the second pressure is less than the first pressure, wherein a first purge cycle is concluded with the deactivating.

17. A system to reduce a pore-water pressure within a subsurface formation below a first pressure, comprising:

a ground water flow regulating device (GFRD), the GFRD is inserted to a depth within a well casing, wherein the GFRD is used to create a sequence of events in the following order, the sequence of events constitutes a first purge cycle as follows:

1. activation of the GFRD to create a pressure discontinuity across the GFRD for a first period of time, the pressure discontinuity is created in part by lowering a water level in the well casing above the GFRD, which causes local pore-water pressure beneath the GFRD to increase; and 2. deactivation of the GFRD to release the pressure discontinuity after the first period of time under local pore-water pressure, when ground water flow resumes, following the release, local pore-water pressure decreases to a second pressure, the second pressure is less than the first pressure.

18. The system of claim 17, wherein the water level in the well casing is lowered by pumping water out of the well casing.

19. The system of claim 18, wherein the water level in the well casing is lowered by pumping water that was above the GFRD into the subsurface formation.

20. The system of claim 17, wherein a magnitude of the pressure discontinuity is selected from a range between zero up to a maximum of a separation height between a well screen and a header pipe associated with the well.

21. A method to reduce a pore-water pressure within a subsurface formation below a first pressure, comprising:

activating a ground water flow regulating device (GFRD) to create a pressure discontinuity in a well for a first period of time, wherein the activating causes local ore-water pressure in the well to increase;

lowering a water level in the well during the creating; and deactivating the GFRD to release the pressure discontinuity after the first period of time under local pore-water pressure, when ground water flow resumes, local pore-water pressure decreases to a second pressure, the second pressure is less than the first pressure, wherein a first purge cycle is concluded with the deactivating.

22. A method to reduce a pore-water pressure within a subsurface formation below a first pressure, comprising:

activating a ground water flow regulating device (GFRD) to create a pressure discontinuity at a depth in a well, for a first period of time, during the activating, the GFRD restricts water flow through the well and a pressure beneath the GFRD increases;

reducing a water level in the well above the GFRD, following the activating; and deactivating the GFRD to release the pressure discontinuity after the first period of time under local pore-water pressure, when ground water flow resumes, local pore-water pressure decreases to a second pressure, the second pressure is less than the first pressure, wherein a first purge cycle is concluded with the deactivating.

* * * * *